US008430205B2

(12) United States Patent
Leung

(10) Patent No.: US 8,430,205 B2
(45) Date of Patent: Apr. 30, 2013

(54) POOL LADDER SAFETY SYSTEM

(75) Inventor: Chi Yin Alan Leung, Kowloon Bay (HK)

(73) Assignee: Polygroup Macau Limited (BVI), Road Town, Tortola (VG)

( * ) Notice: Subject to any disclaimer, the term of this patent is extended or adjusted under 35 U.S.C. 154(b) by 461 days.

(21) Appl. No.: 12/652,920

(22) Filed: Jan. 6, 2010

(65) Prior Publication Data

US 2010/0170749 A1 Jul. 8, 2010

Related U.S. Application Data

(60) Provisional application No. 61/143,006, filed on Jan. 7, 2009, provisional application No. 61/156,100, filed on Feb. 27, 2009, provisional application No. 61/176,565, filed on May 8, 2009.

(51) Int. Cl.
*E06C 1/14* (2006.01)

(52) U.S. Cl.
USPC ..... 182/106; 182/93; 182/180.1

(58) Field of Classification Search ..... 182/106, 182/121, 129, 214, 93, 180.1; 52/184; 4/504; 248/690
See application file for complete search history.

(56) References Cited

U.S. PATENT DOCUMENTS

| | | | | |
|---|---|---|---|---|
| 4,023,647 | A * | 5/1977 | Confer | 182/108 |
| 4,418,792 | A | 12/1983 | Cerone | |
| 5,165,501 | A * | 11/1992 | Donahey | 182/214 |
| 7,017,709 | B1 * | 3/2006 | Laymance | 182/97 |
| 7,101,475 | B1 * | 9/2006 | Maaske et al. | 210/106 |
| 2004/0146359 | A1 * | 7/2004 | Doolaege | 405/115 |
| 2009/0308003 | A1 * | 12/2009 | Juneau et al. | 52/184 |
| 2010/0044154 | A1 * | 2/2010 | Lipniarski | 182/115 |

FOREIGN PATENT DOCUMENTS

CN 201190436 2/2009

OTHER PUBLICATIONS

Definition of weld provided in Action The American Heritage® Dictionary of the English Language, Fourth Edition copyright ©2000 by Houghton Mifflin Company. Updated in 2009. Published by Houghton Mifflin Company. All rights reserved.*

Definition of cast provided in Action The American Heritage® Dictionary of the English Language, Fourth Edition copyright ©2000 by Houghton Mifflin Company. Updated in 2009. Published by Houghton Mifflin Company. All rights reserved.*

Search Report issued by the British Patent Office for related British Patent Application No. GB1000191.5 dated May 10, 2010.

* cited by examiner

*Primary Examiner* — Alvin Chin Shue
*Assistant Examiner* — Daniel Cahn
(74) *Attorney, Agent, or Firm* — Benjamin C. Wiles, Esq.; Troutman Sanders LLP

(57) ABSTRACT

A safety system for a swimming pool ladder is described for use in above-ground swimming pools. The safety system can comprise a frame covered with fabric or other enclosure permanently or temporarily affixed to the ladder and/or the sidewall of an above-ground swimming pool. The fabric can comprise a plurality of vent holes to prevent excessive side loads caused by water currents. The safety system can be detachably coupled to the ladder using a tab and slot configuration. The safety system can prevent objects from entering and becoming trapped between the pool sidewall and the pool ladder.

16 Claims, 23 Drawing Sheets

POOL LADDER SAFETY SYSTEM

CROSS REFERENCE TO RELATED APPLICATIONS AND PRIORITY CLAIM

This application claims the benefit, under 35 U.S.C. §119(e), of U.S. Provisional Patent Application No. 61/143,006, filed 7 Jan. 2009, U.S. Provisional Patent Application No. 61/156,100, filed 27 Feb. 2009, and U.S. Provisional Patent Application No. 61/176,565, filed 8 May 2009. The entire contents and substance of each application is incorporated herein by reference in its entirety as if fully set forth below.

BACKGROUND

Embodiments of the present invention relate to a pool ladder safety system and, more specifically, to a safety system for preventing injury and entanglement with pool ladders used in above-ground swimming pools.

Above-ground swimming pools are known. The most common types of above-ground pools are constructed of steel, resin, plastic, or other materials. Above-ground pools are generally constructed using a perimeter frame, of various designs, with a heavy plastic, vinyl, or fabric liner to contain water. Above-ground pools may also be collapsible to enable convenient storage and/or include portals as disclosed in Cheng et al., U.S. patent application Ser. No. 11/466,681, filed Aug. 23, 2006, the entire disclosure of which is incorporated herein by reference.

Above-ground pools are generally constructed entirely above-ground. In other words, a suitably level site is chosen and the pool is assembled and filled in place. This introduces a problem peculiar to above-ground pools—access. In-ground pools provide easy access because they are, by definition, at the level of the ground around them. One can simply step off of the pool deck and into the in-ground pool, though steps or a ladder are often provided. Therefore, with an in-ground pool one has only to lower themselves into the water.

On the other hand, to access an above-ground pool, a ladder, deck, or other apparatus must be provided to allow the user to first climb up to the level of the pool and then down to enter the water. Additionally, the frame provided with an above-ground pool is often designed only to retain the shape of the liner and provide structural support. The frame may lack the structural rigidity for use as a method to enter the pool. Indeed, many would find it inconvenient, if not impossible, to climb into an above-ground pool using only the frame, regardless of structural considerations.

As a result, most above-ground pools include a deck or ladder to aid ingress and egress. Because the sides of an above-ground pool are generally not sufficiently rigid to support the ladder, the ladder must be either be supported by the pool deck, which itself is free-standing, or the ladder must be a self-supporting A-frame type ladder. In either case, a portion of these ladders generally rest on the bottom of the pool. This creates an area between the pool wall and the ladder in which a swimmer's body and/or limbs can become trapped.

In addition, the ladder in an above-ground pool also tends to lean away from the sidewall of the pool from top to bottom. This creates a roughly triangular area formed by the ladder, the sidewall, and the bottom of the pool in which one can become trapped or entangled. Further, because the ladder and the ladder rungs are farther away from the sidewall of the pool, the chances increase that a swimmer's foot will slip off of the ladder rung and become entangled in the ladder, or between the ladder and the pool.

SUMMARY

Briefly described, an embodiment of the present invention relates to a safety system for a ladder for an above-ground pool. Embodiments of the present invention provide a system that can enclose, or occupy, the space created between the ladder, the pool wall, and the pool bottom in an above-ground pool. The system can prevent objects from entering and becoming trapped between the ladder and the pool wall. The system is designed to be easily installed and portable. In an alternative embodiment, the system may additionally be adapted for used on a ladder for an in-ground pool.

Embodiments of the present invention can comprise a ladder safety system comprising a first side guard. The first side guard can be shaped to substantially occupy an area between a pool ladder and the interior sidewall of an above-ground pool. In this manner, the first side guard can prevent objects from entering the area between the ladder and the interior sidewall. The first side guard can further define at least one aperture to enable media within the pool to pass therethrough. In some embodiments, an attachment assembly can be provided for detachably coupling the first side guard to one of the pool ladder or the interior sidewall of the above-ground pool.

In some embodiments, the first side guard and the attachment assembly are molded from a single piece of material. In other embodiments, the first side guard can comprise a frame shaped to substantially conform to the shape of the area between the pool ladder and the interior of the sidewall of the above-ground pool, and a cover, attached to the frame, to substantially fill an interior portion of the frame. The cover can define the at least one aperture to enable water to pass through the cover and to prevent excessive side loads on the frame.

In some embodiments, the frame can be substantially trapezoidal and can comprise a top, a bottom, a first side, and a second side. In this configuration, the first side can be disposed near the interior sidewall of the pool and can be substantially vertical. The second side can be disposed such that it is substantially parallel to stiles of the ladder, thus defining a generally trapezoidal shape. In other embodiments, the first side of the frame can be curved such that it substantially conforms to the sidewall of the pool. This can be useful, for example and not limitation, for ring-type pools with curved sidewalls. In some embodiments, the cover can comprise an ultraviolet stabilized material and/or a chemically resistant material to improve life in a pool environment.

The attachment assembly can further comprise a mounting slot integrally cast in a rear portion of a ladder rung on a pool ladder. An attachment tab can be welded onto the frame of the first side guard. The attachment tab can be slideably engaged with the mounting slot for detachably coupling the first side guard to the ladder. In some embodiments, the attachment assembly can further comprise a retaining pin for retaining the attachment tab in the mounting slot.

Embodiments of the present invention can further comprise a safety system for above ground pools comprising a free-standing A-frame type ladder system. The A-frame type ladder system can comprise an inner ladder disposed inside the pool, and an outer ladder disposed outside the pool. The ladder system can further comprise rungs each comprising a mounting slot integrally cast into the rungs. The system can further comprise a guard assembly shaped to substantially occupy the area between the inner ladder and a sidewall of the pool. In some embodiments, the guard assembly can define at least one vent hole to enable water within the pool to pass through the guard assembly. The guard assembly can further comprise one or more attachment tabs, attached to the guard assembly, and configured to slideably engage the slots in the one or more rungs for securing the guard assembly to the inner ladder. The attachment tabs can be welded to the guard assembly.

In some embodiments, the guard assembly and the attachment tabs can be blow molded from a single piece of plastic. In other embodiments, the attachment tabs are riveted to the guard assembly. In some embodiments, the one or more ladder rungs and the mounting slots can be integrally cast from a thermoplastic. The system can further comprise further comprising one or more retaining pins with one or more retaining tabs for removably securing the attachment tabs in the mounting slots.

Embodiments of the present invention can comprise a ladder safety system for use in an above-ground pool with an A-frame type ladder system comprising an inner ladder, disposed inside the above-ground pool, an outer ladder, disposed outside the above-ground pool, and one or more rungs comprising an integral mounting slot. The ladder safety system can comprise a first side guard to prevent objects from entering the area between the ladder and the interior sidewall.

The first side guard can comprise a frame and a cover. The frame can be shaped to substantially conform to an area between the pool ladder and an interior sidewall of the above-ground pool. The cover can be disposed over the frame, and can define one or more openings to enable water within the pool to pass therethrough. The first side guard can further comprise one or more mounting tabs welded to the frame for slideably engaging the integral mounting slots on the ladder system and comprising a retaining hole.

In some embodiments, the system can further comprise one or more retaining pins for engaging the retaining hole in the one or more mounting tabs. The retaining pins can retain the first side guard in the integral mounting slots on the ladder system. The retaining pins can further comprise one or more retaining tabs for frictionally engaging the retaining hole in the mounting tabs, and a ring, to facilitate removal of the retaining pin.

In some embodiments, the frame can comprise a rust resistant material, such as for example and not limitation, powder coated steel. In some embodiments, the cover can comprise vinyl welded to the frame.

To the accomplishment of the foregoing and related ends, the following description and annexed drawings set forth in detail certain illustrative aspects and implementations of the invention. These are indicative of but a few of the various ways in which the principles of the invention may be employed. Other aspects, advantages, and novel features of embodiments of the invention will become apparent from the following detailed description of the invention when considered in conjunction with the drawings.

DETAILED DESCRIPTION

To facilitate an understanding of the embodiments, principles, and features of the present invention, they are explained hereinafter with reference to their implementation in illustrative embodiments. In particular, embodiments of the present invention are described in the context of being a safety system for a ladder for a swimming pool.

Embodiments of the present invention, however, are not limited to use as a safety system for a pool ladder. Rather, embodiments of the present invention can be used for above-ground pool ladders, in-ground pool ladders, and other applications. For example, although embodiments of the present invention are described as preventing unwanted entanglement between a ladder for an above-ground pool and the sidewall thereof, it can be used to prevent such entanglement in conjunction with an in-ground pool or indeed, in many situations where the use of a ladder presents such dangers.

Figure 1:
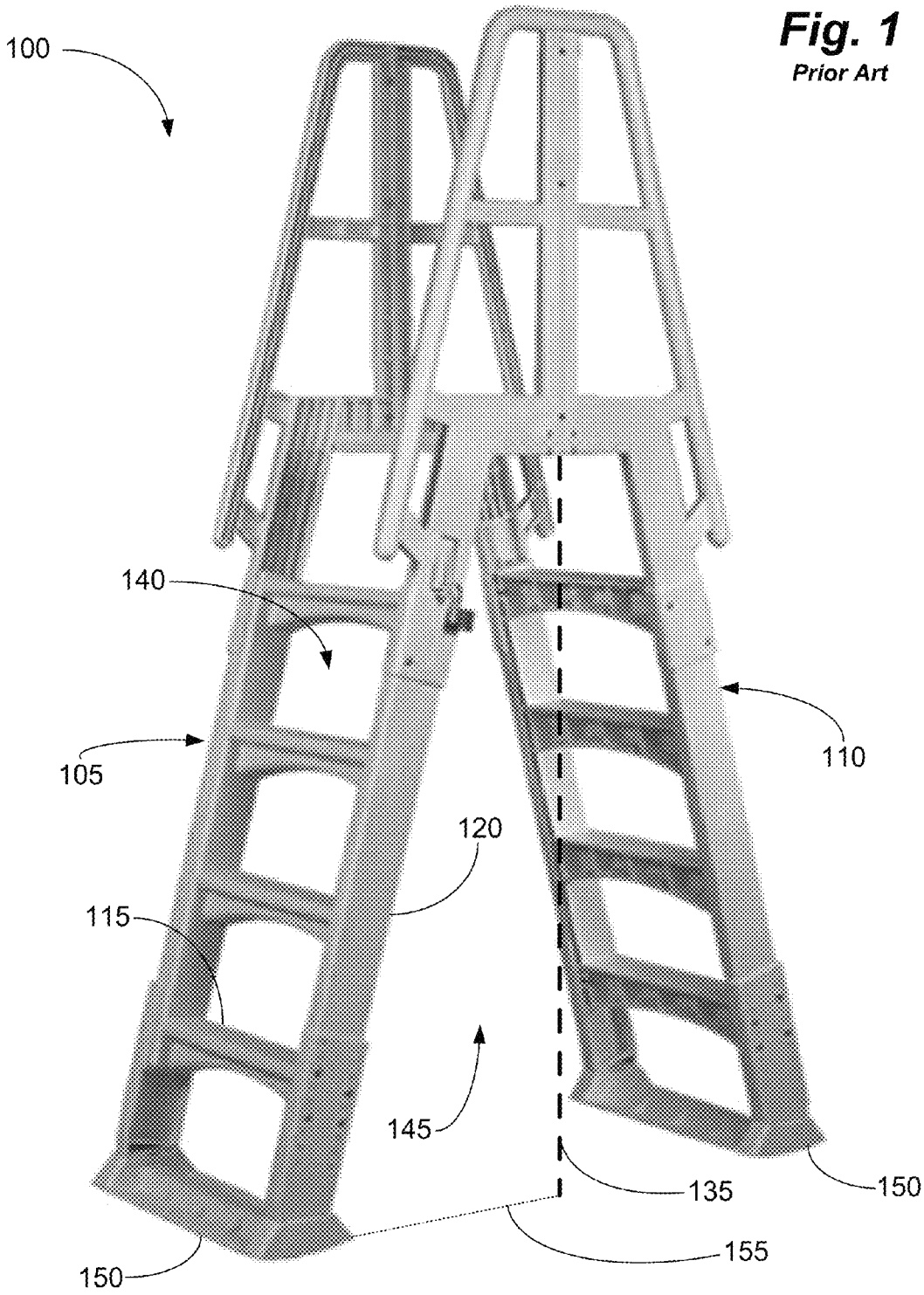
Fig. 1 Prior Art
FIG. 1 depicts a perspective view of a conventional A-frame type above-ground pool ladder.

Referring now to the figures, FIG. 1 depicts a conventional A-frame type above-ground pool ladder 100. Mounting a ladder to the sidewall of an above-ground pool can be undesirable, or impossible, due to the construction of above-ground pools. Ladders for above-ground pools, therefore, tend to be free standing A-frame type ladders 100. The ladder 100 can comprise an outer ladder 110 resting on a foot 150 on the ground outside the pool. The outer ladder 110 can be in communication near its top with an inner ladder 105, forming and A-framed ladder 100. The inner ladder 105 can rest on a foot 150 on the bottom 155 of the pool, represented in FIG. 1 by a dotted line. When the ladder 100 is inserted into the pool, a cavity 145 is formed between the inner ladder 105 and the sidewall 135 of the pool, represented by a vertical dashed line in FIG. 1.

This configuration of the ladder 100 and sidewall 135 can create several dangerous situations. For instance, because the inner ladder 105 is, by definition, wet, it is common for a swimmer's foot to slip off the rung 115 of the inner ladder 105. Due to the distance between the inner ladder 105 and the sidewall 135 of the pool, it is possible for the swimmer's foot to go through the box 140 formed by the rungs 115 and the stiles 120 of the inner ladder 105 and become trapped. The swimmer's foot can become trapped in the ladder 105 itself, or can become wedged between the ladder 105 and the sidewall 135 of the pool. This can result in injury due to contact with either the ladder 105 or the sidewall 135 of the pool. In a worst case, the swimmer can become trapped and/or drown.

A second dangerous situation is that the swimmer can inadvertently become trapped in the cavity 145 formed by the inner ladder 105, the bottom 155 of the pool, and the sidewall 135 of the pool. This can occur because the swimmer is playing in the water on or near the ladder 105 or simply because the swimmer inadvertently swims between the ladder 105 and the sidewall 135. In either case, the possibility for injury and/or death may be imminent.

Figure 2:
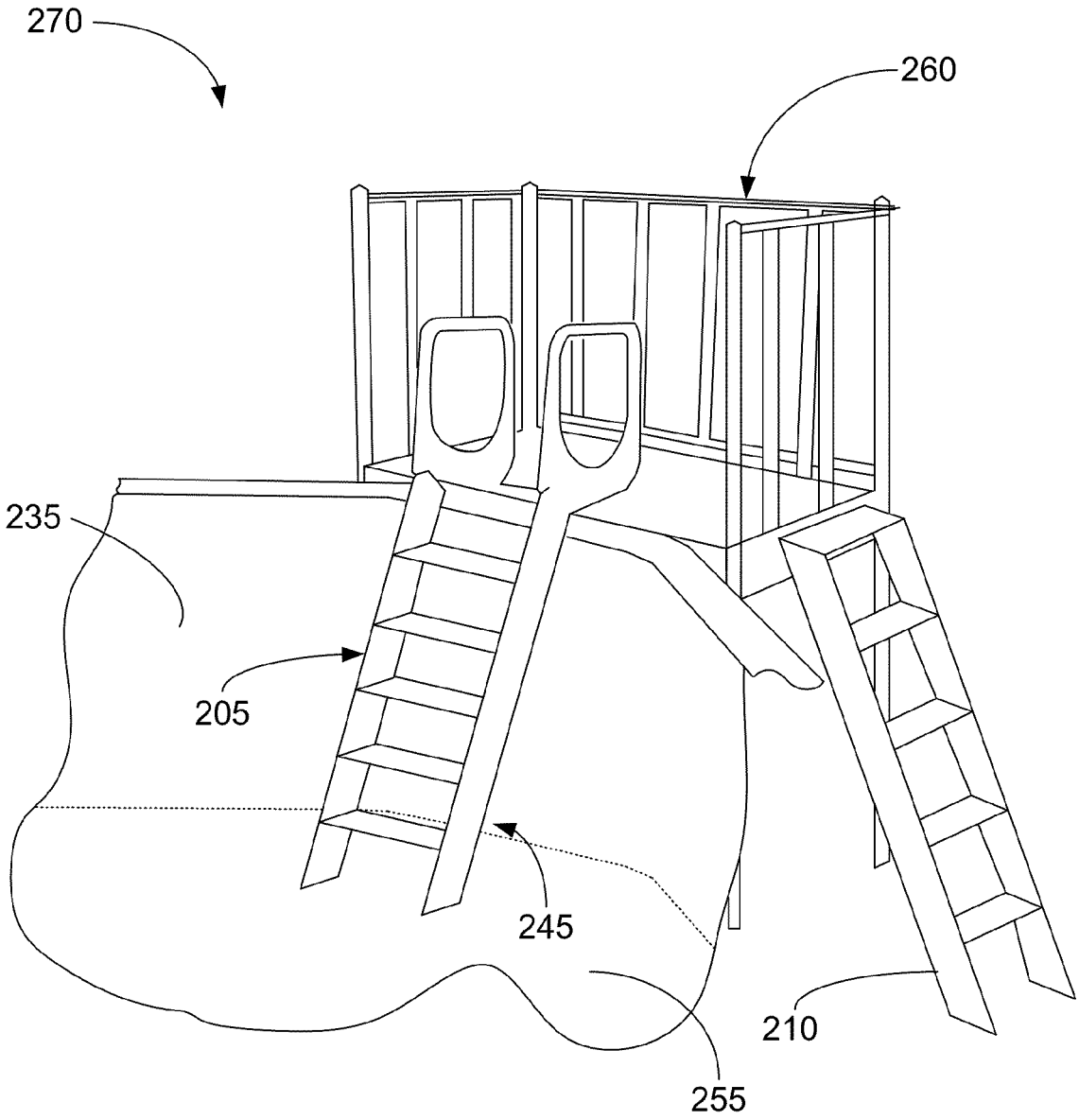
Fig. 2 PRIOR ART
FIG. 2 depicts a perspective view of a conventional deck and ladder system used in association with above-ground pools.

These situations can also be present when a pool deck is used in conjunction with an above-ground pool. A conventional, exemplary pool deck 270 is shown in FIG. 2. Pool decks 270 can include an inner ladder 205, outer ladder 210, and deck area 260. As before, because the inner ladder 205 is angled away from the sidewall 235 and rests on the bottom 255 of the pool, a cavity 245 is formed between the inner ladder 205, the sidewall 235, and the bottom 255 of the pool. This presents the same danger of a swimmer becoming entangled in the ladder or entrapped in the cavity 245 mentioned above.

As a result, there are at least two problems with conventional means with entering/exiting a swimming pool. A first problem is to prevent a swimmer's limbs and/or body from becoming intertwined in the rungs and stiles of the ladder itself. A second problem is to prevent the swimmer from becoming entrapped or entangled in the cavity formed by the inner ladder, the bottom of the pool, and the sidewall of the pool. It is to these safety issues that embodiments of the present invention are primarily directed.

Figure 3:
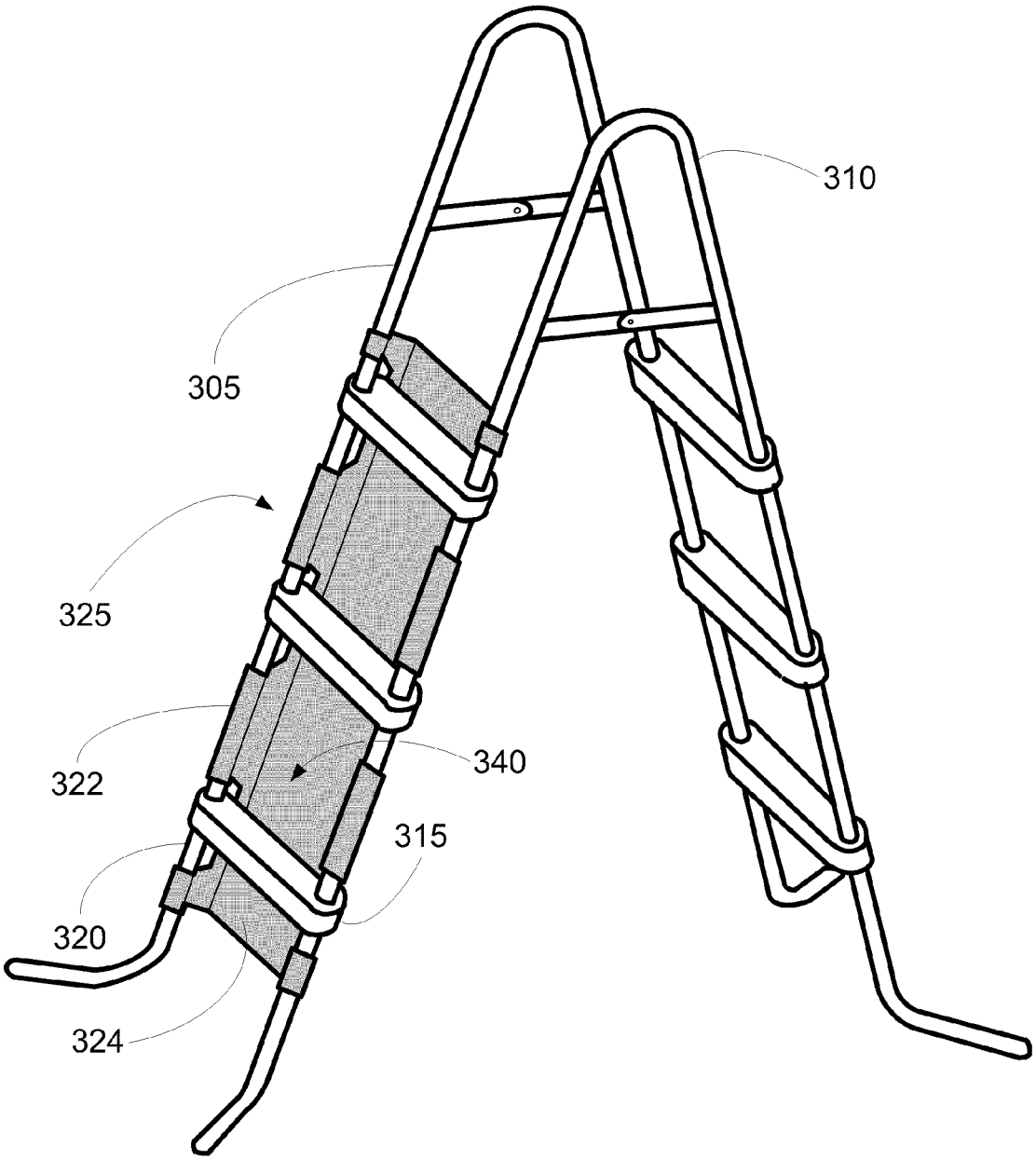
FIG. 3 depicts a perspective view of a rung guard installed on an A-frame type above-ground pool ladder, in accordance with some embodiments of the present invention.

FIG. 3 illustrates the rung guard 325 installed on an A-frame type pool ladder comprising an inner ladder 305, which is positioned within the perimeter of the pool, and an outer ladder 310, which is positioned outside the perimeter of the pool. The rung guard 325 can occupy the space directly behind the rungs 315 of the inner ladder 305. The rung guard 325 can prevent the swimmer's foot from passing through the hole 340 in between the rungs 315 and stiles 320 of the ladder.

The rung guard 325 can be, for example and not limitation, a fabric guard sewn with loops suitable to slip over the stiles 320 of the inner ladder 305. In some embodiments, the rung guard 325 can be comprised of a resilient material compatible with the pool environment, for example and not limitation, such as nylon, polyester, canvas, Sunbrella®, and so on. In an alternative embodiment, the rung guard 325 can be comprised of a rigid material such as metal, plastic, and the like.

The rung guard 325 can comprise a plurality of stile attachment points 322 and a rear guard surface 324. In some embodiments, as shown in FIG. 3, the stile attachment points 322 can be loops sewn into the fabric and slipped over the stiles 320 of the ladder. This embodiment provides security, by can require the rung guard 325 to be installed during manufacture or for the ladder 305 to be disassembled for installation. In an alternative embodiment, the stile attachment points 322 can comprise fabric tabs with a zipper, Velcro®, or other fastening means to enable for easy installation and removal. In yet another embodiment, the rung guard 325 can comprise eyelets through which rope, cord, cable ties ("zip ties"), or other fastening means can be inserted and then coupled to the stiles 320 of the ladder 305.

In some embodiments, the rung guard 325 can comprise a rigid material such as metal or plastic. In some embodiments, the stile attachment points 322 can be molded directly into the rung guard 325. For instance, the stile attachment points 322 can be molded tubes through which the stiles 320 can be inserted during assembly. In yet another embodiment, the stile attachment points 322 can be molded U-shaped channels capable of snapping over the stiles 320 of the inner ladder 305. The U-shaped channels can securely, yet removably attach the rung guard 325 to the inner ladder 305. In yet another embodiment, the stile attachment points 322 can be clamps, zip ties, brackets, strapping, or other means suitable for permanently or removably affixing the rung guard 325 to the inner ladder 305.

The rung guard 325 further comprises a rear guard surface 324. The rear guard surface 324 can be shaped to conform to the profile of the rear of the ladder rungs 315. In some embodiments, the rear guard surface 324 can be shaped such that it touches or is in close proximity to the rear of the ladder rungs 315. This close proximity can prevent the foot, arm, or other appendage of the swimmer from passing through the gap 340 formed by the ladder rungs 315 and the stiles 320.

For example and not limitation, if the rung guard 325 is installed, and a swimmer is climbing up the ladder 305 and a foot slips inwardly off the rung 315, the swimmer's foot is prevented from entering the gap 340 in the ladder 305 by the rung guard 325. This can stop the forward motion of the swimmer's foot and enable the swimmer to continue climbing the ladder 305. In the worst case, the swimmer falls harmlessly back into the pool to try again.

In some embodiments, the outer ladder 310 can be equipped with a rung guard 325. In many instances, the outer ladder 310 can also become wet as swimmers, especially children, climb in an out of the pool during use. As a result, safety of the outer ladder 310 can also benefit from installation of a rung guard 325 on the outer ladder 310.

Figure 4:
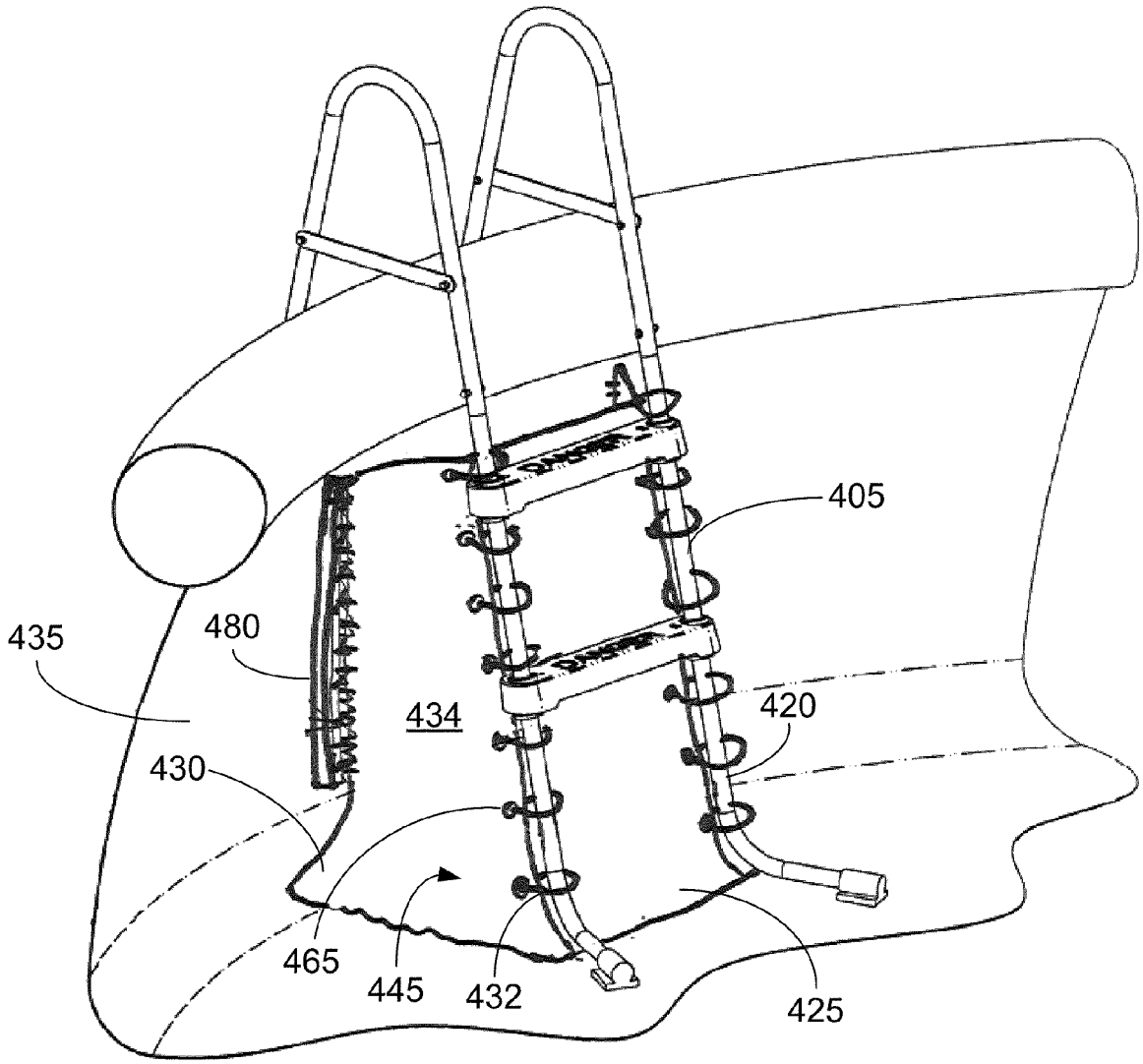
FIG. 4 depicts a perspective view of a pool ladder safety system installed in an above-ground pool, in accordance with some embodiments of the present invention.

Another problem with ladders for pools is the possibility that the swimmer will unintentionally become trapped or entangled in the area 445 between the ladder 405 and the pool wall 435. This can result, for example and not limitation, from children playing on or around the ladder. A swimmer may also inadvertently swim into the area 445 while swimming with their eyes closed. This problem can be resolved by implementing a side guard 430, as illustrated in FIG. 4. The side guard 430 is designed to cover or fill the gap 445 created between the inner ladder 405 and the sidewall 435 of the pool. The side guard 430 can be separate from, or integrated with, the rung guard 425.

The side guard 430 can comprise a plurality of stile attachment points 432 and a cover 434. In some embodiments, the stile attachment points 432 can be loops sewn into fabric and slipped over the stiles 420 of the inner ladder 405. This embodiment provides security, but can require the side guard 430 to be installed at the factory or the ladder 405 to be disassembled for installation. In an alternative embodiment, the stile attachment points 432 can comprise fabric tabs with zipper, Velcro®, or other fastening means to enable for easy installation and removal. As shown in FIG. 4, the side guard 430 can include eyelets 465 and can be installed using rope, zip ties, aircraft cable, or other suitable means. The side guard 430 can also be attached using, for example and not limitation, clips, snaps, bolts, or screws.

The side guard 430 can comprise a rigid material such as metal or plastic. In some embodiments, the stile attachment points 432 can be molded directly into the side guard 430. For instance, the stile attachment points 432 can be molded tubes through which the stiles 420 can be inserted during assembly. In some embodiments, the stile attachment points 432 can be molded U-shaped channels capable of snapping over the stiles 420 of the inner ladder 405. The stile attachment points 432 can be, for example, clamps, zip ties, brackets, or other means suitable for permanently or removably affixing the side guard 430 to the inner ladder 405.

The side guard 430 can further comprise a cover 434. The cover 434 can be shaped to conform to the profile of the inner ladder 405 and/or the sidewall 435 of the pool. In one embodiment, the cover 434 can be a polygon with linear sides that remains in close proximity to the sidewall 435 of the pool and the stiles 420 of the ladder 405. This can be desirable, for example, to reduce complexity and/or production costs. The close proximity of the side guard 430 to the sidewall 435 and the inner ladder 405 prevents, for example, a foot, arm, or other object from passing through the gap 445 formed by the inner ladder 405 and the pool sidewall 435.

In some embodiments, the side guard 430 can be attached to the sidewall 435 of the pool. This can be desirable if, for example, the side guard 430 is made from a flexible material, such as, for example, nylon, cotton, or canvas. Attaching the side guard 430 to the sidewall 435 of the pool can enable the side guard 430 to conform to the shape of the sidewall 435 and can hold an otherwise flexible material in place. This can be done, for example and not limitation, using Velcro®, zippers, or other fastening means 480, adapted to removably or permanently affix the side guard 430 to the sidewall 435 of the pool. In some embodiments, the side guard 430 and the rung guard 425 can comprise a single piece of material, as shown in FIG. 4.

Figure 5A:
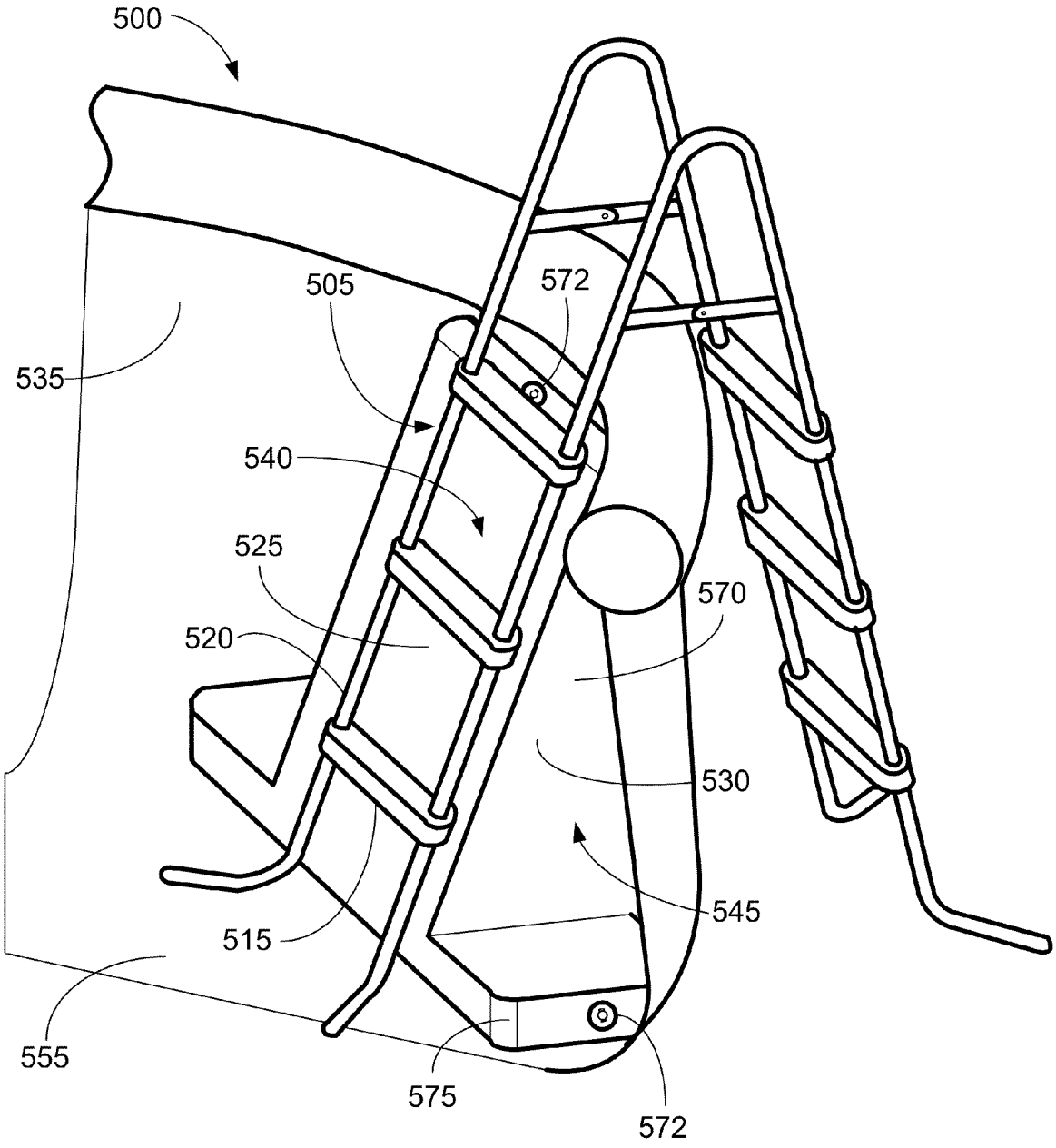
FIG. 5*a* depicts a perspective view of an inflatable pool ladder safety system installed in an above-ground pool, in accordance with some embodiments of the present invention.
Figure 5B:
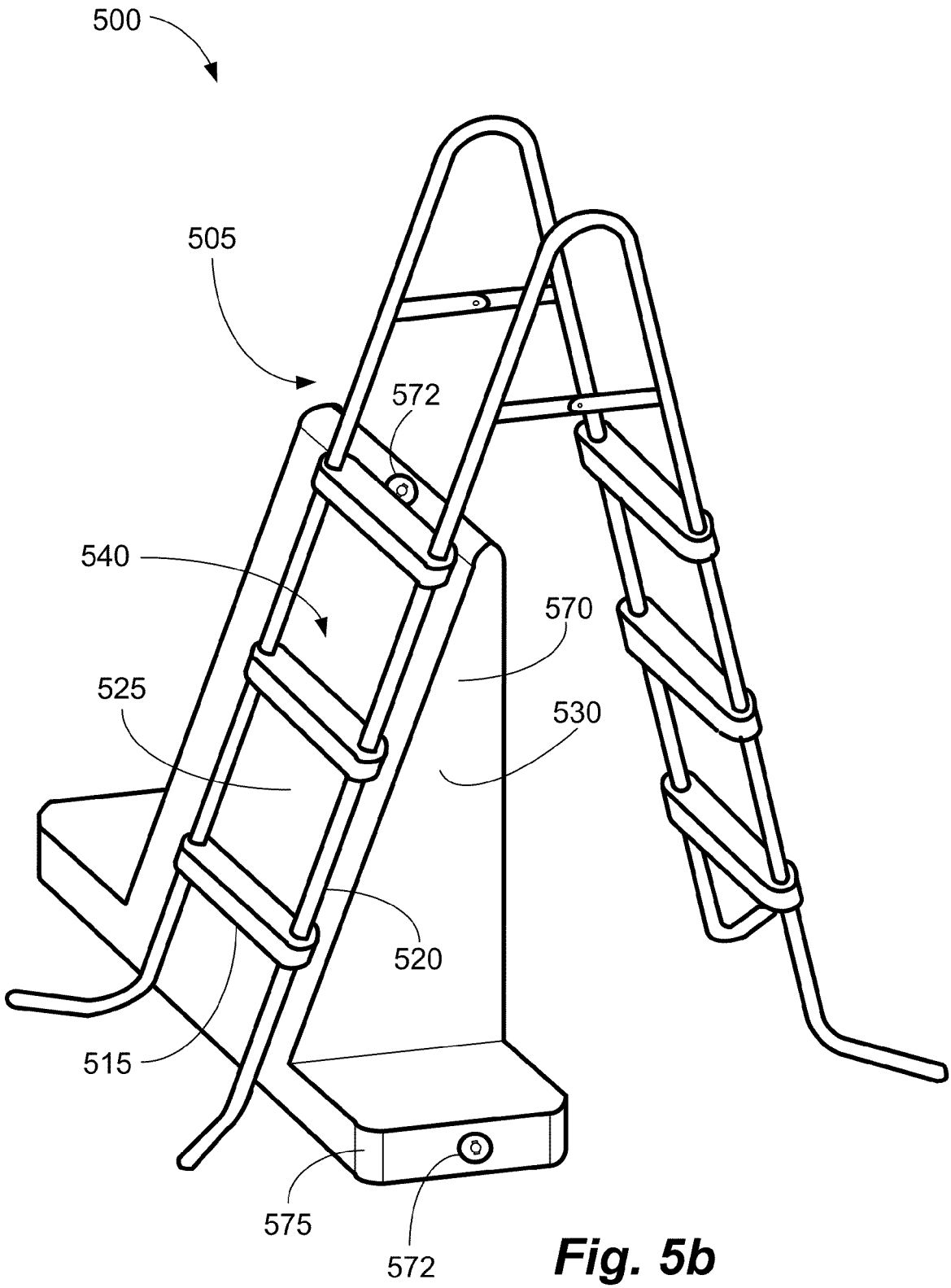
FIG. 5*b* depicts a perspective view of the inflatable pool ladder safety system of FIG. 5*a*, in accordance with some embodiments of the present invention.

As shown in FIGS. 5*a* and 5*b*, a ladder safety system 500 can be an inflatable system comprising both the rung guard 525 and the side guard 530 in a single inflatable bladder or multiple, compartmentalized bladders. The inflatable ladder safety system 500 can be filled with various materials such as, for example and not limitation, air, water, sand, aggregate, or other materials. The ladder safety system 500 can be filled to enable it to stand upright and conform to the space 545 formed between the pool ladder and the pool sidewall 535. The ladder safety system 500 can also be inflated such that it prevents the objects from entering the space 540 between the rungs 515 and stiles 520 of the inner ladder 505.

In some embodiments, the ladder safety system 500 can comprise a flexible material such as nylon, canvas, polyester, and so on. The material can be adapted to contain the filling media and to withstand the pool environment. This can enable the ladder safety system 500 to be portable. In other words, the filling media can be removed leaving only the flexible, lightweight bladder material for transportation. This can enable the ladder safety system 500 to be deflated and folded for easy transport for use in a new location.

Manufacturing the ladder safety system 500 with flexible materials can also enable the system 500 to conform to various pool ladders 505 and sidewall 535 configurations. In other words, because the ladder safety system 500 is flexible and inflatable, it can be inflated, or deflated, as needed to conform to different pool configurations. The user can simply place the ladder safety system 500 under the ladder 505 and inflate, or fill, the ladder safety system 500 until it occupies the space between the ladder 505 and the pool sidewall 535. The can enable the same system 500 to conform to a pool with vertical sidewalls 535 or a pool with non-vertical sidewalls, such as a ring-type pool.

In some embodiments, the ladder safety system 500 can be filled with air. This can enable it to be inflated and deflated very quickly, for example, using a standard air bed inflator/deflator. This can be desirable when portability is a central concern. The ladder safety system 500 can be inflated and frictionally held in place by the ladder 505 and pool sidewall 535. In other embodiments, it can be desirable to attach the ladder safety system 500 to the pool ladder 505, the sidewall 535, or both, to prevent the ladder safety system 500 from floating and/or becoming dislodged. In some embodiments, the system 500 can comprise a plurality of eyes and can be attached using a variety of attachment means, including but not limited to, cable, zip ties, or rope.

In yet another embodiment, the ladder safety system 500 can be filled with water from the pool, a garden hose, or other source. The can enable the ladder safety system 500 to have substantially neutral buoyancy in the pool. The ladder safety system 500 can, as a result, rest on the bottom 555 of the pool and fill the space between the pool ladder 505 and the sidewall 535. The ladder safety system 500 can be filled quickly using, for example, the pump from the filter on the pool. The ladder safety system 500 can then be emptied and removed by emptying the water from the bladder or bladders.

The ladder safety system 500 can also be filled with sand, gravel, or other aggregate. This can enable the ladder safety system 500 to be filled to the appropriate level such that it fills the space between the ladder 505 and the sidewall 535. This can enable the ladder safety system 500 to be substantially solid. This can also enable the ladder safety system 500 to have negative buoyancy and sit firmly on the bottom of the pool 555. The additional weight can enable the ladder safety system 500 to remain in position without additional securing means, although additional means may nonetheless be desirable. The additional weight can provide the added benefit of maintaining the shape and/or or position of the pool bottom 555. The ladder safety system 500 can be made portable by removing the aggregate from the bladder, or bladders, and then removing the ladder safety system 500 from the pool.

In some embodiments, the ladder safety system 500 can comprise upper 570 and lower 575 bladders. The bladders 570, 575 can further comprise filler tubes or valves 572. This can enable the bladders 570, 575 to be filled with air, water, aggregate and/or other materials to inflate the ladder safety system 500. In other embodiments, the ladder safety system 500 can comprise one bladder to reduce manufacturing costs. In yet another embodiment, the ladder safety system 500 can comprise more than two bladders to compartmentalize the effects of a bladder puncture.

The use of multiple bladders can also be useful to customize the shape of the ladder safety system 500 to a variety of pool/ladder configurations. In other words, the shape of the system 500 can be customized by varying the inflation level of several bladders to achieve the desired shape. In this manner, the same system 500 can be used, for example, in a pool with vertical sidewalls 535, as shown in FIG. 5*a*, or a pool with non-vertical sidewalls such as a ring-type pool.

Figure 6:
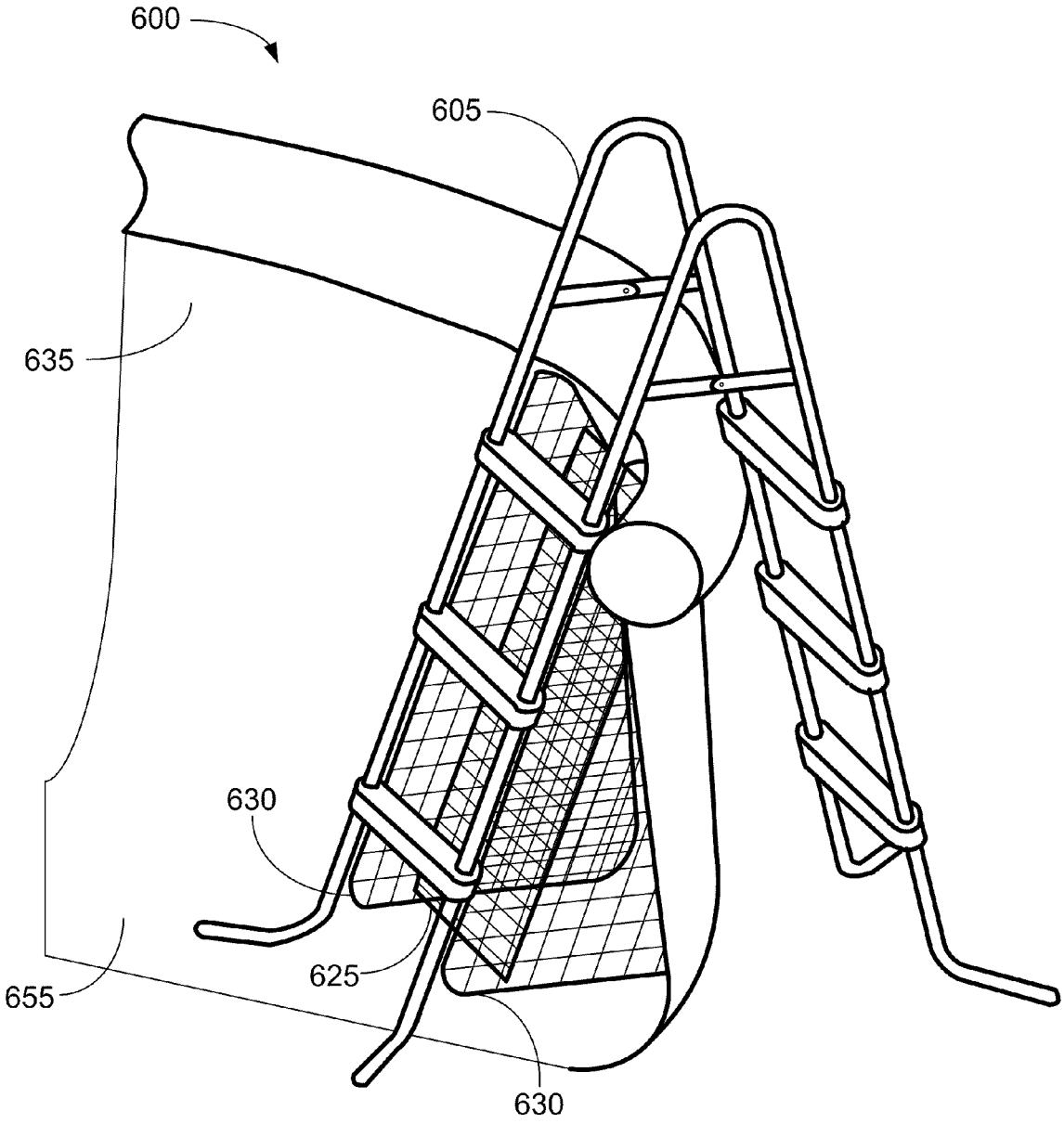
FIG. 6 depicts a perspective view of a mesh-type pool ladder safety system installed in an above-ground pool, in accordance with some embodiments of the present invention.

As shown in FIG. 6, embodiments of the ladder safety system 600 can comprise one or more side guards 630 and a rung guard 625 comprised of a mesh material. The ladder safety system 600 can be manufactured from, for example and not limitation, wooden lattice, expanded or welded wire mesh, or can be molded from plastic, nylon, or other suitable materials. This can enable water to flow freely around and through the ladder safety system 600 and can minimize the volume of water displaced by the system 600.

The side guards 630 and the rung guards 625 can have multiple configurations. For example, the side guards 630 and the rung guard 625 can be molded integrally or can comprise separate pieces. In some embodiments, the side guards 630 can be attached to the pool ladder 605 using a suitable fastening means and can support the rung guard 625. In other embodiments, the ladder safety system 600 can be appropriately sized and can be free standing, resting on the bottom 655 of the pool.

Figure 7:
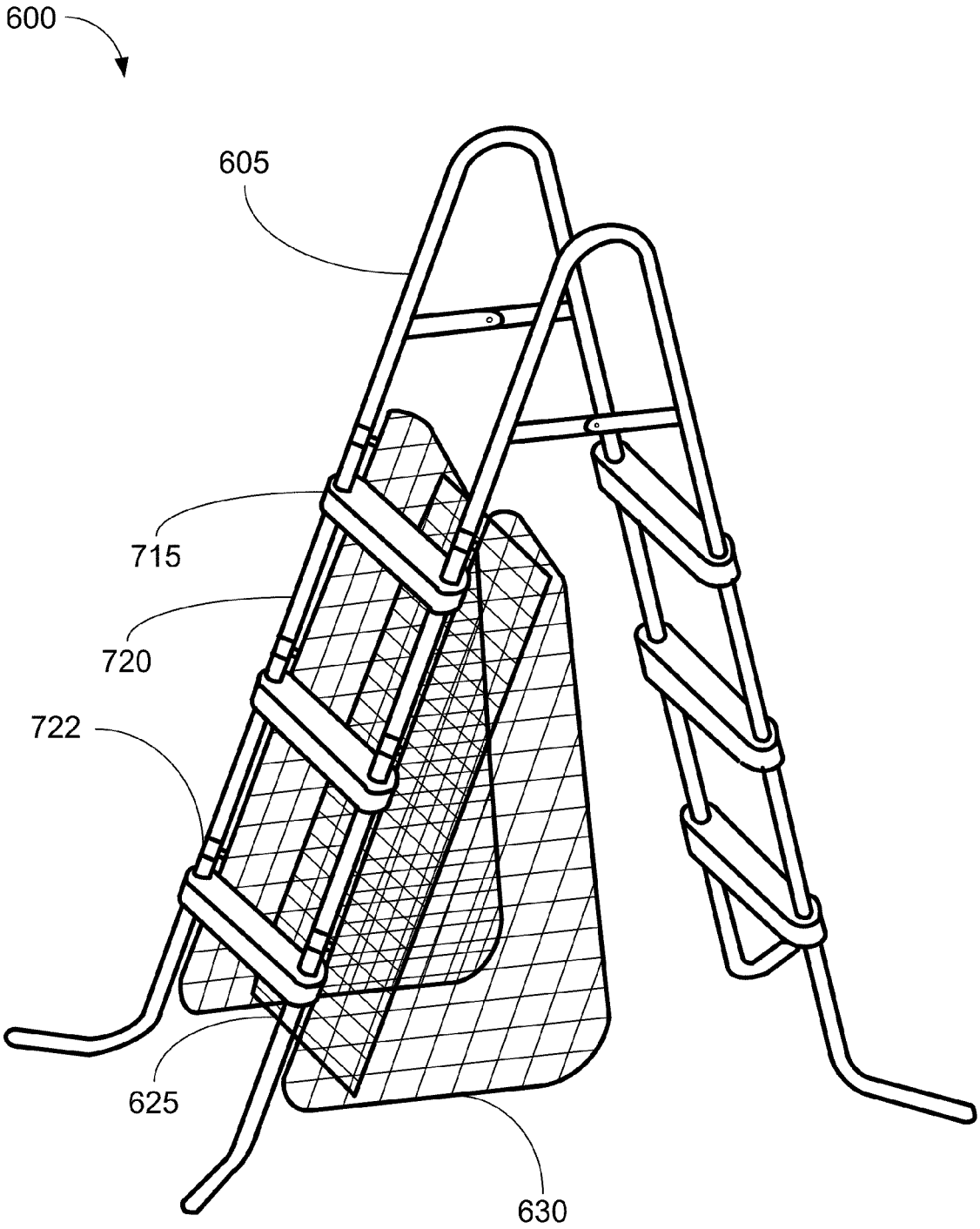
FIG. 7 depicts a perspective view of a mesh-type pool ladder safety system of FIG. 6, in accordance with some embodiments of the present invention.

As shown in FIG. 7, the ladder safety system 600 can comprise a plurality of stile attachment points 722. In some embodiments, the side guards 630 and/or the rung guard 625 can further comprise stile attachment points 722. This can enable the ladder safety system 600 to be attached to the stiles 720 of the inner ladder 605. The stile attachment points 722 can comprise, for example and not limitation, clips, bands, or loops and can clip or slide over the stiles 720 of the inner ladder 605.

Figure 8:
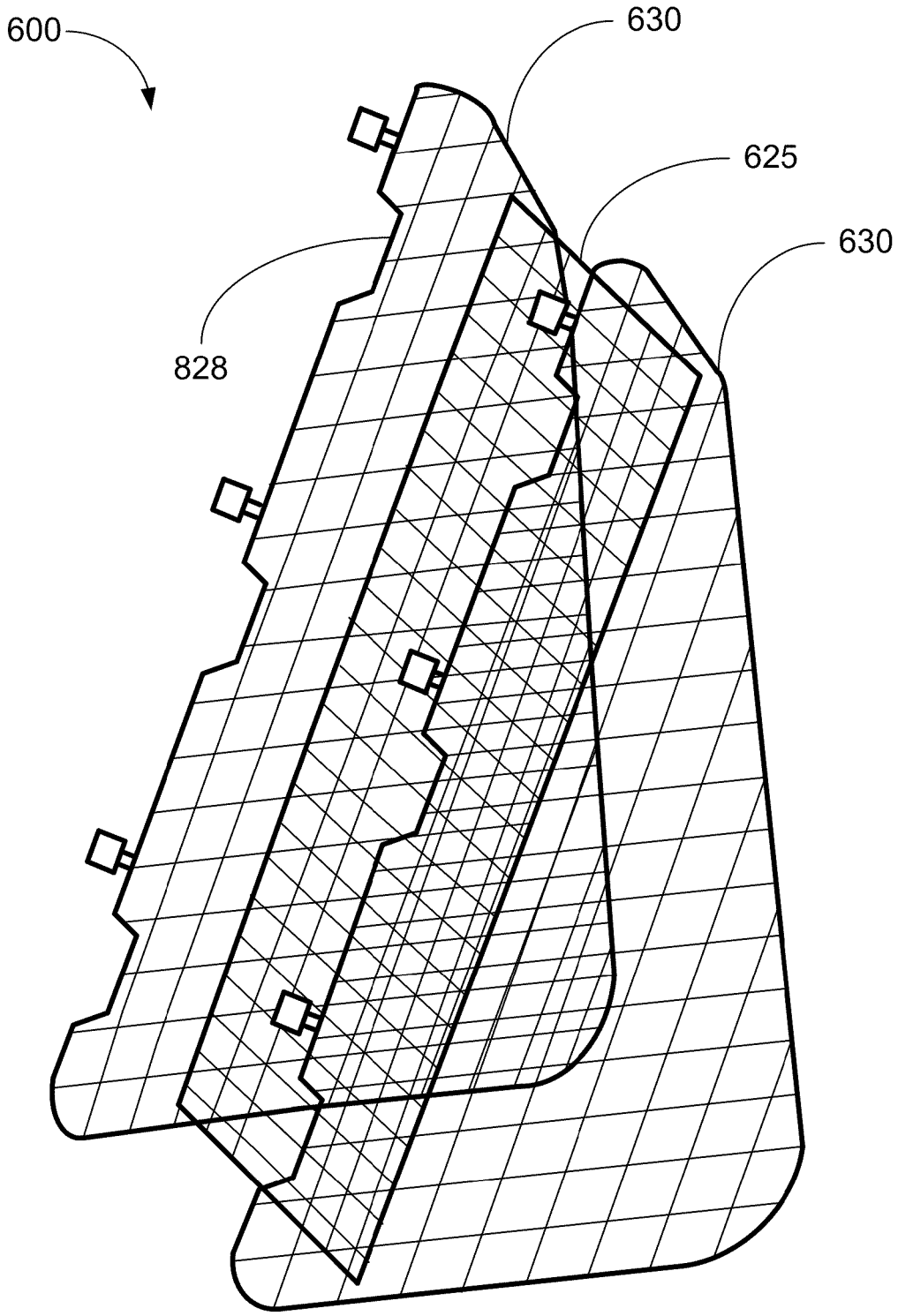
FIG. 8 depicts a perspective view of the mesh-type pool ladder safety system of FIGS. 6-7, in accordance with some embodiments of the present invention.

As shown in FIG. 8, a ladder safety system 600 can comprise a plurality of cutouts 828 to provide clearance around the rungs 715 of the inner ladder 605. This can enable the side guards 630 to fit tightly against the stiles 720 of the inner ladder 605, which can prevent even very small objects from entering the space between the side guard 630 and the inner ladder 605.

In some embodiments, the rung guard 625 can be attached to the side guards 630. This can, among other things, enable the ladder safety system 600 to be free-standing. The rung guard 625 is attachable to the side guards 630, for example and not limitation, by being integrally cast, welded, soldered, bolted, screwed, pinned, clipped, or riveted. The rung guard 625 can further comprise stile attachment points (not shown), or other suitable means, to enable the rung guard to be attached directly to the inner ladder 605.

Figure 9:
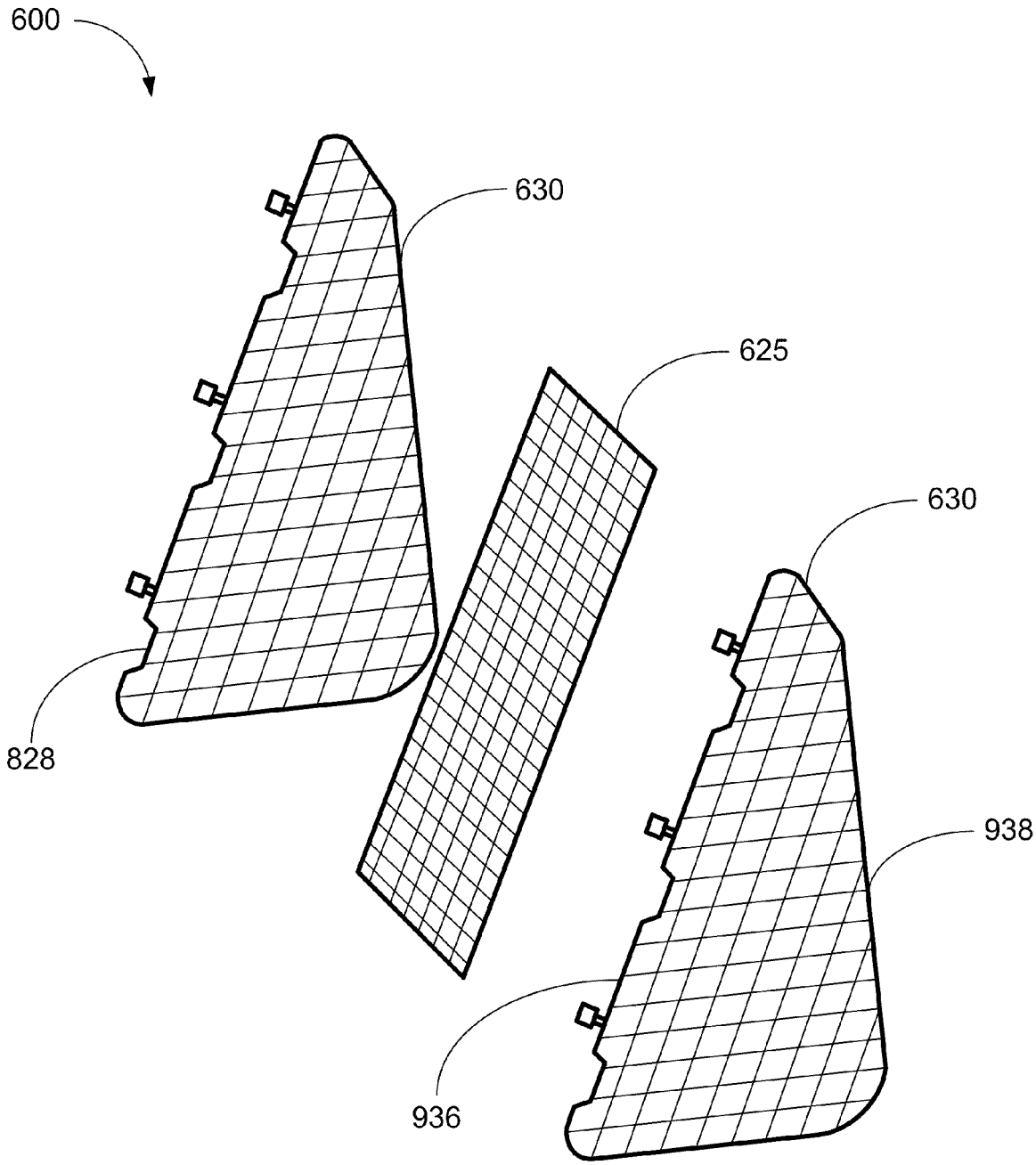
FIG. 9 depicts an exploded, perspective view of the pool ladder safety system of FIGS. 6-8, in accordance with some embodiments of the present invention.

As shown in FIG. 9, the rung guard 625 and the side guards 630 can be manufactured separately. This can enable the ladder safety system 600 to be packaged in an advantageous manner. For example, this can enable the rung guard 625 and the side guards 630 to be flat packed in the same box for convenient shipping. In other embodiments, the rung guard 625 and the side guards 630 can be flat-packed in separate boxes to avoid, for example and not limitation, overweight shipping fees and/or to prevent injury due to excessive weight.

Additionally, the separate rung guard 625 and side guards 630 can enable customization of a generic ladder safety system 600 to better fit certain pools, ladders, and/or pool/ladder combinations. The grid design of the ladder safety system 600 can enable the size and shape of the side guard 630 to be customized, for example, such that the front portion 936 closely fits the rung pattern of a particular ladder. Alternatively, the rear portion 938 of the side guard 630 can be customized to closely fit the side wall of a pool. This can enable a single side guard 630 design to be customized to fit a variety of pool sidewalls. For example, the side guard 630 can be customized to fit standard pools with vertical sidewalls and ring pools with curved sidewalls.

The rung guard 625 can also be customized. For example, the rung guard 625 can be narrowed to correspond to the width of different ladders. Alternatively, the custom cutouts 828 can be cut into the rung guard 625 to match the pattern of the rungs on a particular ladder. This can enable the ladder safety system 600 to conform to many types of pools and/or ladders with a minimum number of models. This, in turn, can reduce development and production costs, increase profits, and lower overall prices to consumers.

Figure 10:
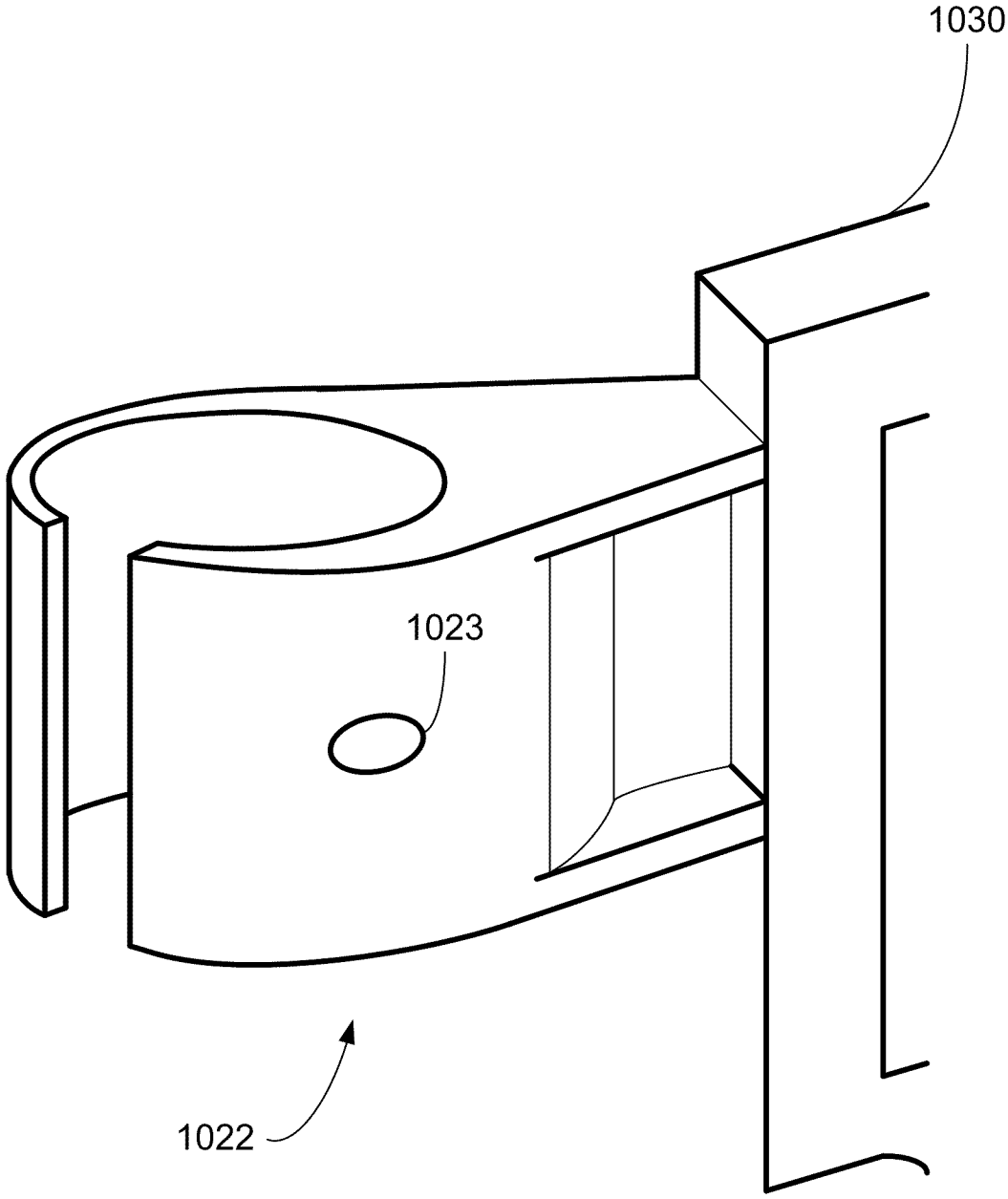
FIG. 10 depicts a perspective view of a stile attachment point for the pool ladder safety system, in accordance with some embodiments of the present invention.

As shown in FIG. 10, the side guard 1030 and can further comprise one or more stile attachment points 1022. The stile attachment points 1022 can enable the side guards 1030 to be detachably affixed to the stiles 720 of the inner ladder 605. In some embodiments, the stile attachment points 1022 can comprise a clamp 1022 that can enable the side guard 1030 to be frictionally attached to the stiles 720 of the inner ladder 605. In some embodiment, the stile attachment points 1022 can be molded into the side guard 1030. The stile attachment points 1022 can also be affixed to the side guard 1030 using other suitable attachment means, such as for example and not limitation, welding, adhesive, solder, bolts, screws, rivets, pins, or zip ties.

The stile attachment points 1022 can comprise one or more attachment holes 1023. The attachment holes 1023 can correspond to mounting holes drilled, or otherwise provided, on the inner ladder 605. The attachment holes 1023 can enable the side guard 1030 to be detachably or permanently affixed to the inner ladder 605 using, for example and not limitation, bolts, screws, rivets, pins, clips, or zip ties. In some embodiments, the rung guard 625 can use a similar attachment means 1022 and can attach to the stiles 720 of the inner ladder 605.

Figure 11:
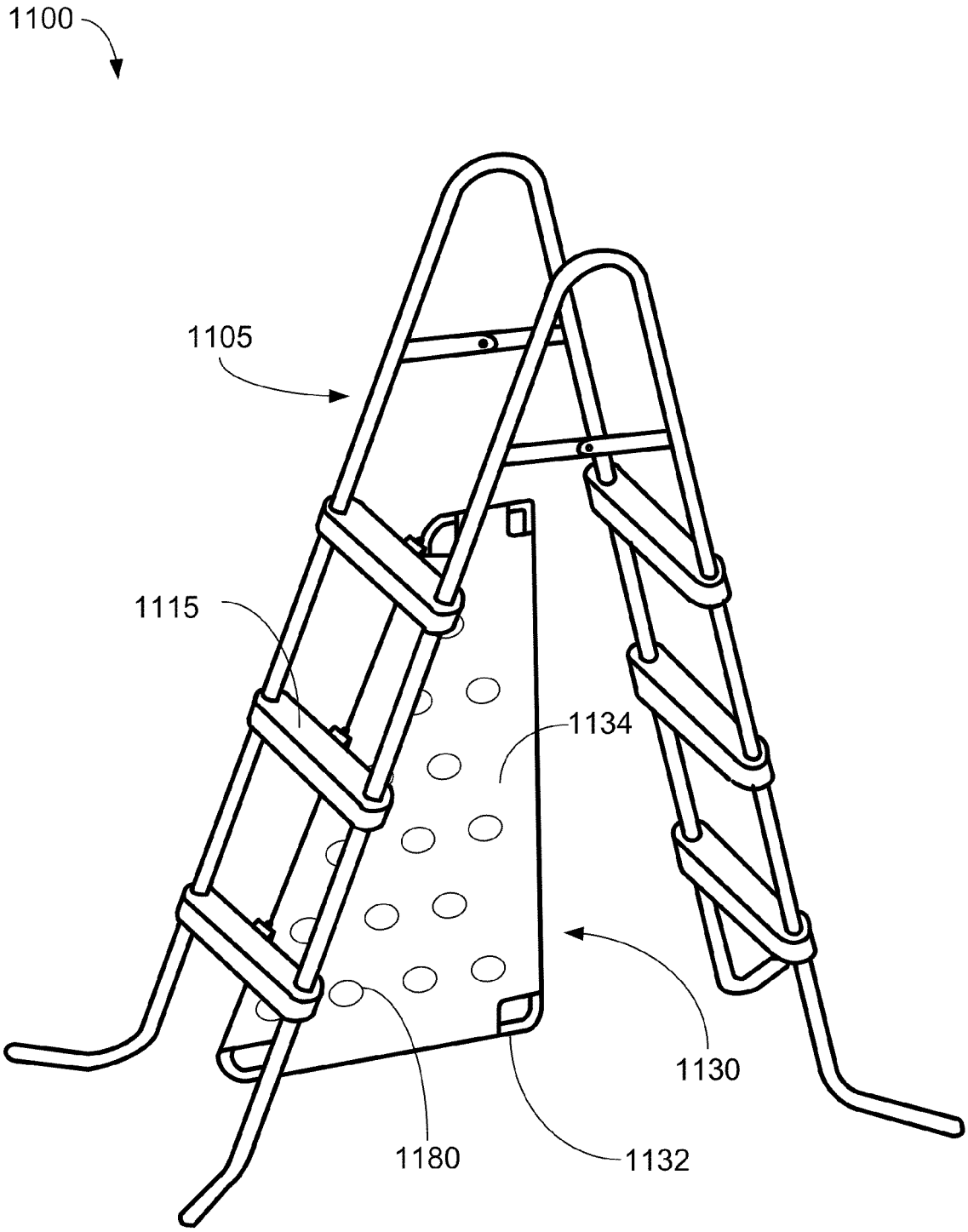
FIG. 11 depicts a perspective view of a frame-type embodiment of a pool ladder safety system, in accordance with some embodiments of the present invention.

As shown in FIG. 11, the safety system 1100 can comprise a single side guard 1130 attached to the inner ladder 1105. In some embodiments, the side guard 1130 can be attached to a middle portion of the rungs 1115 of the inner ladder 1105. This can prevent swimmers from swimming under the ladder 1105 far enough to become entrapped. In addition, because only one side guard 1130 is used, manufacturing and assembly costs are minimized.

In some embodiments, the side guard 1130 can comprise a frame 1132 and a cover 1134. The frame 1132 can comprise a suitably rigid material, such as for example and not limitation, aluminum, powder coated steel, plastic, or nylon, and can be formed to substantially occupy the space between the inner ladder 1105 and the sidewall of the pool. In some embodiments, the frame 1132 can be cast, such that it is unitarily formed. In some embodiments, the frame can be made of a rust-resistant material.

The cover 1134 can comprise a substantially flexible material and can be stretched over the frame 1132 to form the side guard 1130. In some embodiments, the cover 1134 can comprise a material that is suitably resistant to outdoor use and pool chemicals such as, for example and not limitation, Sunbrella®, PVC, cotton, nylon, and the like. The cover 1134 can be stretched over and attached to itself or the frame 1132 using a suitable means. In some embodiments, the cover 1134 can be sewn to form a pocket and can slip over the frame 1132.

The water in swimming pools often includes various currents. These can be caused by the filtration system for the pool, or by people swimming and playing in the pool. As a result, the cover 1134 can further comprise one or more vent holes 1180. The vent holes 1180 can enable currents to pass through the side guard 1130, while preventing excessive side forces on the side guard 1130. This can enable the frame 1132 to be made of a lightweight and inexpensive material without bending or deforming due to currents in the pool.

In some embodiments, the frame 1132 and cover 1134 of the side guard 1130 can be formed integrally. For example and not limitation, the side guard 1130 can be blow molded from plastic and can be formed to include the vent holes 1180. Using a chemical and weather resistant plastic, for example, can enable the side guard 1130 to be substantially sealed and impervious to the elements, improving service life.

Figure 12A:
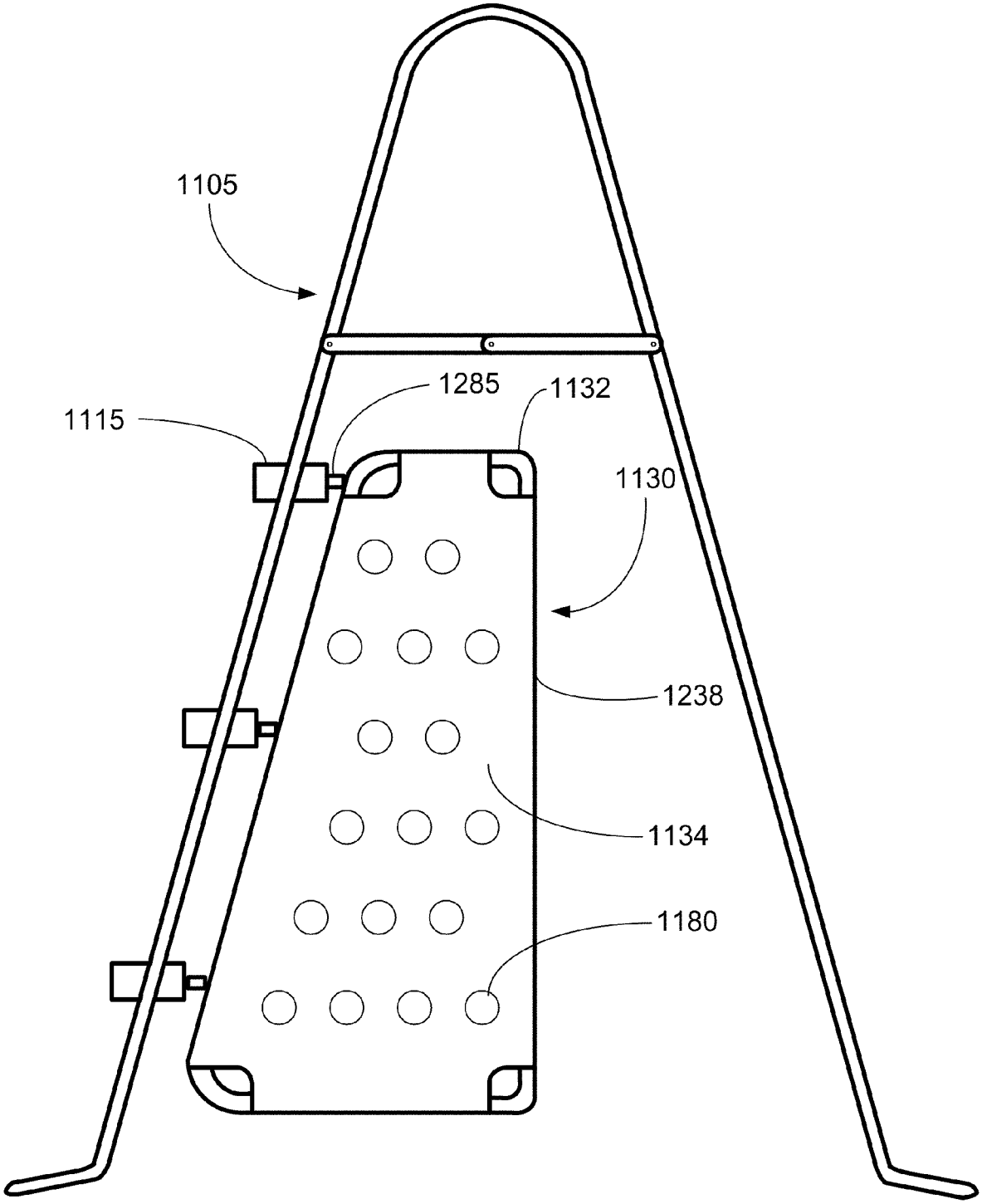
FIG. 12*a* depicts a side view of the frame-type embodiment of the pool ladder safety system of FIG. 11, in accordance with some embodiments of the present invention.

As shown in FIG. 12*a*, the side guard 1130 can be attached to the rungs 1115 of the inner ladder 1105 using attachment means 1285. The attachment means 1285 can be attached to the rungs 1115 using, for example and not limitation, screws, bolts, rivets, pins, or adhesive. The side guard 1130 can be attached to the attachment means 1285 using, for example and not limitation, screws, bolts, rivets, pins, or adhesive. In some embodiments, the attachment means 1285 can comprise two pieces that slide or snap together.

The side guard 1130 can be permanently or removably attached to the attachment means 1285. The side guard 1130 can be attached to the attachment means 1285, for example, using snaps, slots, or other securely detachable means. This can enable the side guard 1130 to be removed to enable, for example, pooling cleaning, pool repair, or to clean or repair the side guard 1130 or inner ladder 1105.

In some embodiments, the attachment means 1285 can feature a break-away design. In other words, if the side guard 1130 is exposed to a significant side load, the attachment means 1285 can enable the side guard 1130 to break away from the ladder 1105 to prevent injury and/or property damage. The force required to cause the attachment means 1285 to break-away can be set to prevent break-away in all but the most extreme cases to enable the side guard 1130 to perform its primary functions (e.g., to prevent swimmers from swimming between the ladder 1105 and the sidewall 535) without breaking away. The attachment means 1285 can break away, for example and not limitation, when a force in excess of about 20 foot-pounds is applied to prevent injury and or property damage. This can prevent personal injury and can prevent damage to the rungs of the ladder.

As mentioned above, the side guard 1130 can comprise a frame 1132 and a cover 1134. The cover 1134 can further comprise one or more vent holes 1180. This can enable water to pass through the cover 1134 and minimize side forces exerted on the frame 1132 and attachment means 1285 cause by currents in the water due to swimming, cleaning, or other activities in the pool.

In some embodiments, the cover 1134 can be comprised of a material stretched over, sewn to, or otherwise attached to the frame 1132. In some embodiments, the cover 1134 can also comprise a material that is suitably resistant to outdoor use and pool chemicals such as, for example and not limitation, Sunbrella®, PVC, cotton, or nylon. In some embodiments, the frame 1132 can comprise a material that is suitably resistant to outdoor use and pool chemicals such as, for example and not limitation, powder-coated steel, stainless steel, plastic, or nylon.

In other embodiments, the side guard 1130 can be integrally formed. In other words, the frame 1132 and cover 1134 can be formed from a single, suitably stiff material. For example and not limitation, the side guard 1130 can be molded in a frameless manner from a single piece of rigid plastic or nylon. This can enable the side guard 1130 to be manufactured at reduced material and labor costs because the cover 1134 does not have to be attached to a frame 1132 to form the side guard 1130. In some embodiments, the side guard 1130 can be cast with integral attachment means 1285 for attaching the side guard 1130 to the rungs 1115 of the inner ladder 1105. In still other embodiments, the attachment means 1285 can be attached to the side guard 1130 using, for example and not limitation, screws, bolts, rivets, pins, or adhesive.

In some embodiments, the rear portion 1238 of the side guard 1130 can be approximately vertical when installed to conform to the sidewall 135, 235 of a pool with approximately vertical sidewalls 135, 235. In other embodiments, the side guard 1130 can be adapted for use with a conventional ring-type pool. Due to the construction of a ring-type pool, the sidewall of the pool tends to be curved or angled outwardly. Therefore, the rear portion 1238 of the side guard 1130 can be curved or angled to match the contours of the sidewall of the pool.

Figure 12B:
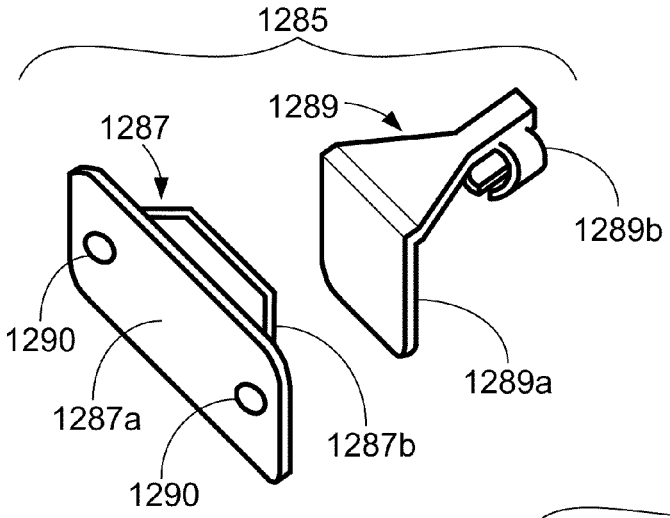
FIGS. 12*b* and 12*c* depict side, perspective views of embodiments of attachment elements for the pool ladder safety system of FIG. 11, in accordance with some embodiments of the present invention.
Figure 12C:
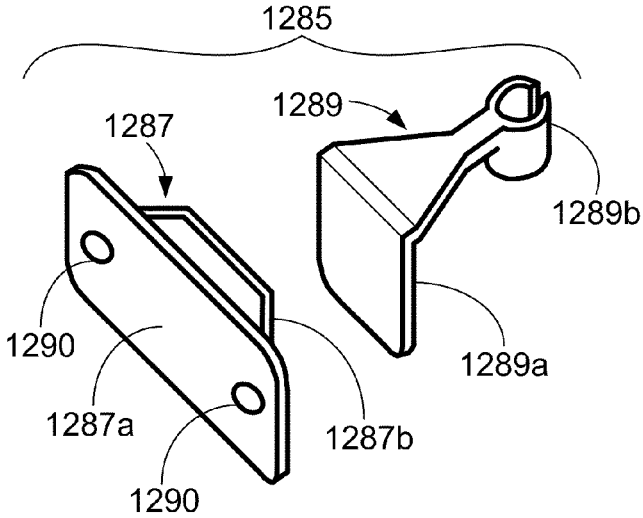

As shown in FIGS. 12*b* and 12*c*, the attachment means 1285 can comprise one or more ladder brackets 1287 and one or more side guard brackets 1289. The ladder bracket 1287 can comprise a mounting flange 1287*a* and a slot 1287*b*. The side guard bracket 1289 can comprise a tab 1289*a* and a mounting clip 1289*b*.

The ladder bracket 1287 can be securely affixed to the ladder 1105 using a suitable adhesive or fastener. In some embodiments, the mounting flange 1287*a* can be affixed to the ladder 1105 using a suitable adhesive, such as for example and not limitation, epoxy, cyanoacrylate, or silicone. The mounting flange 1287*a* can further comprise one or more mounting holes 1290 and can be attached to the ladder 1105 using suitable fasteners, such as for example, bolts, screws, rivets, or pins. The ladder bracket 1287 can comprise a slot 1287*b* suitable to receive the tab 1289*a* on the side guard bracket 1289. See, FIG. 12*d*.

The side guard bracket 1289 can be securely affixed to the side guard 1130 using the mounting clip 1289*b*. The mounting clip 1289*b* can be mounted at various angles, including but not limited to, approximately horizontal (FIG. 12*b*) and approximately vertical (FIG. 12*c*) for mounting on various portions of the side guard 1130 or side guard frame 1132. The mounting clip 1289*b* can be configured to clip over the side guard 1130 to frictionally mount the tab 1289*a* to the side guard 1130. The side guard bracket 1289 can further comprise a tab 1289*a* configured to slideably engage the slot 1287*b* on the ladder brackets 1287. See, FIG. 12*d*.

Figure 12D:
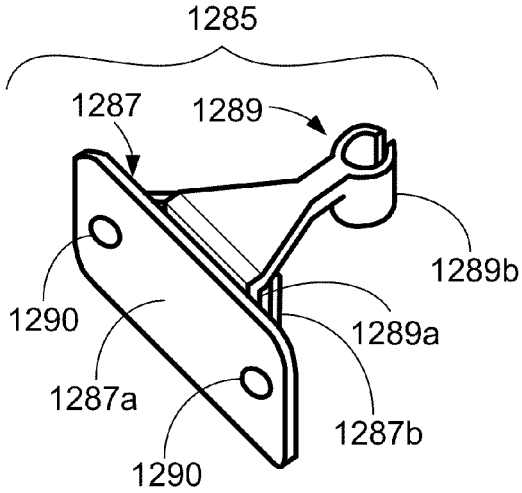
FIG. 12*d* depicts a side, perspective view of embodiments of attachment elements for the pool ladder safety system of FIG. 11, in a coupled position, in accordance with some embodiments of the present invention.

The brackets 1287, 1289 can enable the side guard 1130 to be installed and removed quickly and easily. For instance, the ladder bracket 1287 can be attached to the ladder 1105 using a suitable adhesive or fastener before inserting the inner ladder 1105 in the pool. The inner ladder 1105 can then be inserted in the pool. The side guard bracket 1289 can then be attached to the side guard 1130 using clips 1289*b* or other suitable means. As shown in FIG. 12*d*, the side guard 1130 can be affixed to the ladder 1105 by sliding the tab 1289*a* into the mounting slot 1287*b*. The side guard 1130 can be easily removed to enable pool cleaning or maintenance by simply lifting the tabs 1289*a* out of the slots 1287*b* and removing the side guard 1130 from the ladder 1105. Of course, many suitable methods for attaching the side guard 1130 to the ladder 1105 exist and are contemplated herein.

Figure 13:
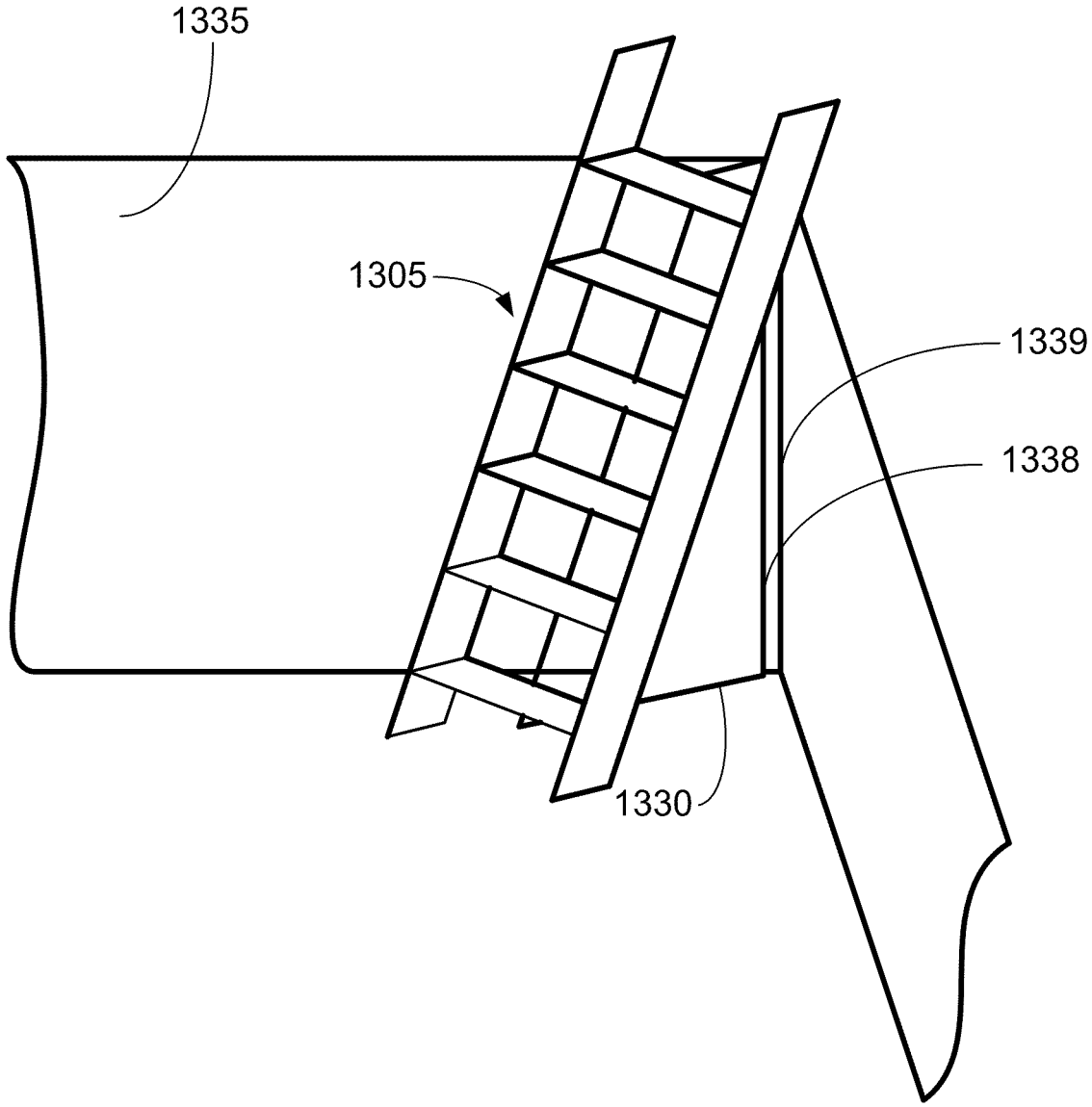
FIG. 13 depicts a perspective view of a pool ladder safety system installed in a corner of an above-ground pool, in accordance with some embodiments of the present invention.

As shown in FIG. 13, the inner ladder 1305 can be positioned such that it straddles the corner 1339 of a rectangular or square pool. In this configuration, the pool sidewall 1335 is farther from the inner ladder 1305 than when the inner ladder 1305 is placed adjacent a flat or curved portion of a sidewall 1335 of a pool. In some embodiments, therefore, the rear portion 1338 of the side guard 1330 can be extended to meet the sidewall 1335 of the pool in the corner 1339. Indeed, the side guard 1330 can be manufactured to fit a variety of pool/ladder configurations and, in some embodiments, can be customizable in situ.

Figure 14:
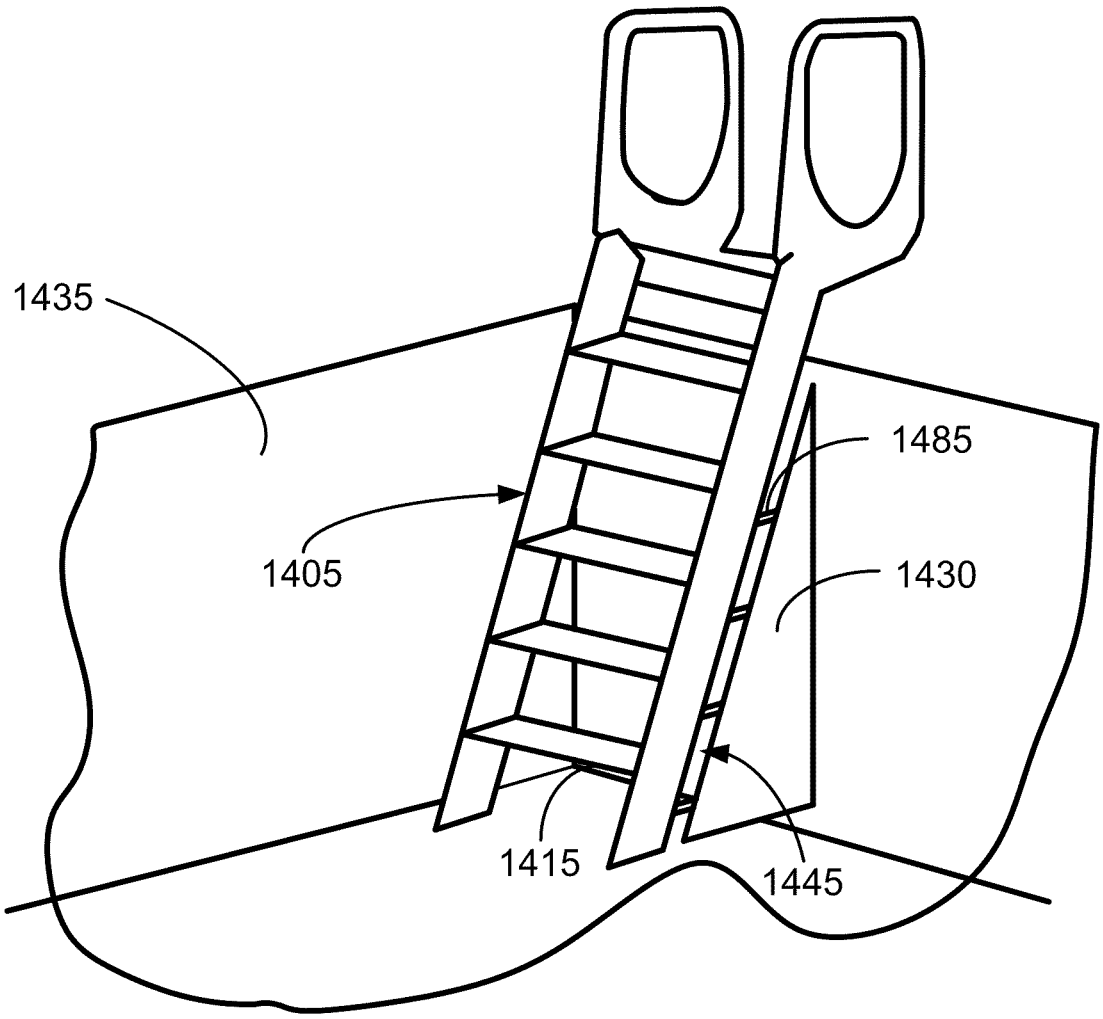
FIG. 14 depicts another perspective view of a pool ladder safety system installed in a corner of an above-ground pool, in accordance with some embodiments of the present invention.

As shown in FIG. 14, the inner ladder 1405 can be positioned such that one side of the ladder 1405 is adjacent the sidewall 1435 of the pool. In this configuration, the side guard 1430 can be positioned on the side of the inner ladder 1405 opposite the sidewall 1435 and can be attached, for example and not limitation, to the rungs 1415 using brackets 1485 or the stiles using loops (not shown), or other suitable fastening means. This can prevent swimmers from entering the area 1445 between the inner ladder 1405 and the sidewall 1435 using a single side guard 1430.

Figure 15:
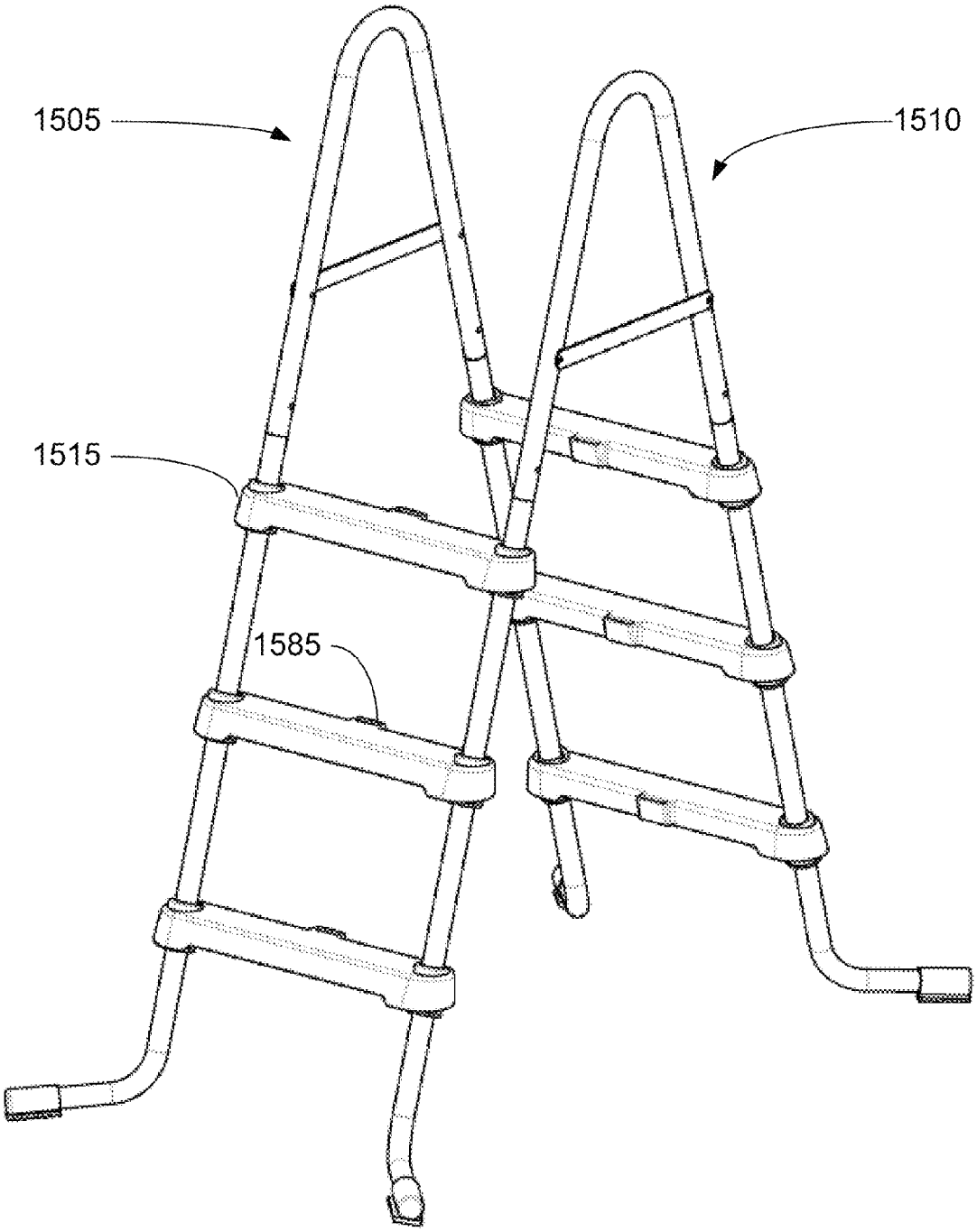
FIG. 15 depicts a perspective view of an A-frame type ladder with an attachment slot integrated into the rungs, in accordance with some embodiments of the present invention.
Figure 16:
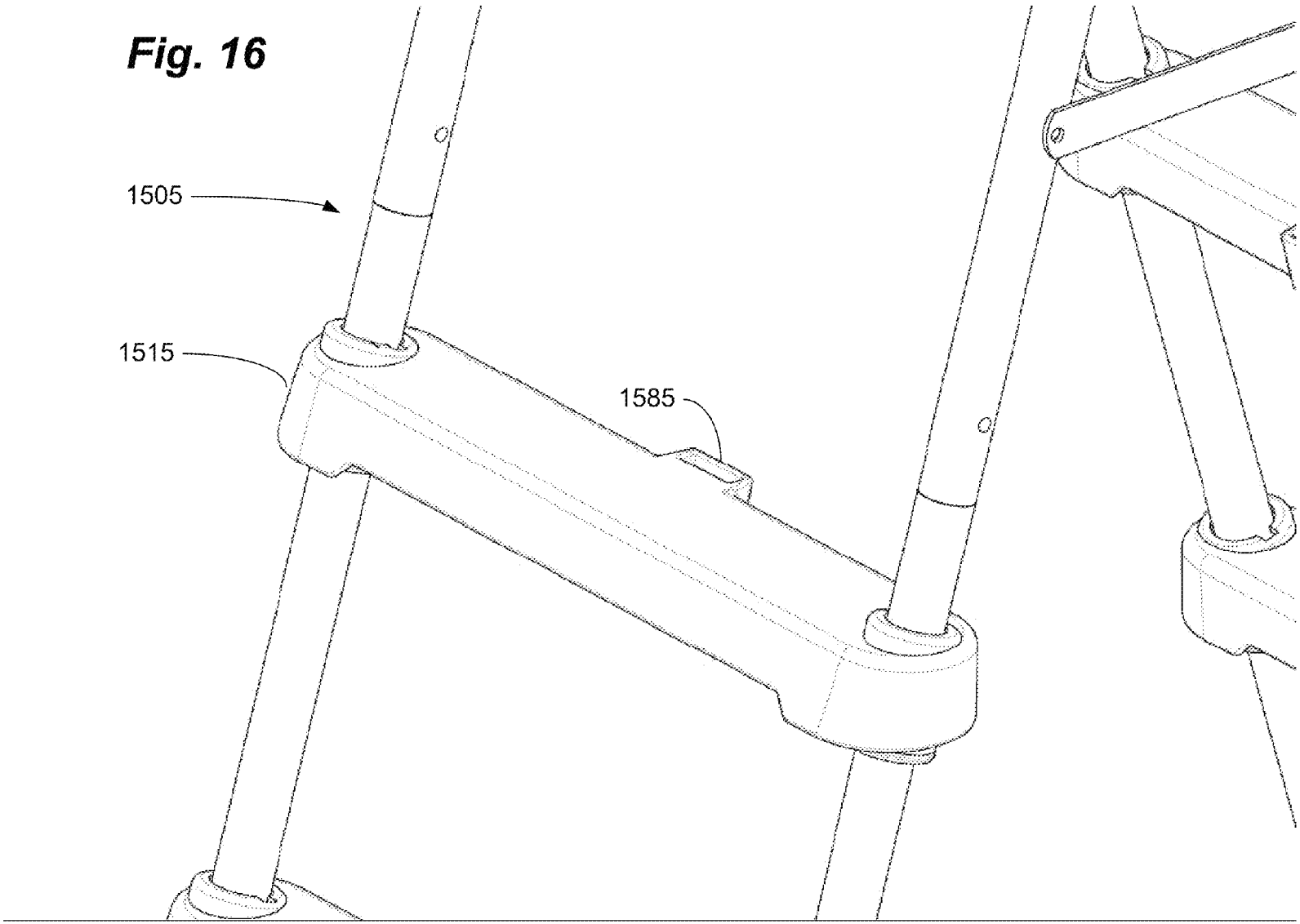
FIG. 16 depicts a detailed, perspective view of the A-frame type ladder of FIG. 15 with the attachment slot integrated into the rungs, in accordance with some embodiments of the present invention.

In some embodiments, as shown in FIG. 15 and more closely in FIG. 16, the rungs 1515 of the ladders 1105, 1110 can further comprise a slot 1585. The slot 1585 can be cast integrally with the rung 1515 to improve strength and reduce manufacturing costs. The rungs 1515 can be cast from, for example and not limitation, a thermoplastic to enable the slot 1585 to be cast integrally with the rung 1515. In some embodiments, the slot 1585 can be attached to the rung 1515 using other suitable means, such as for instance, bolts, screws, or rivets.

Figure 17A:
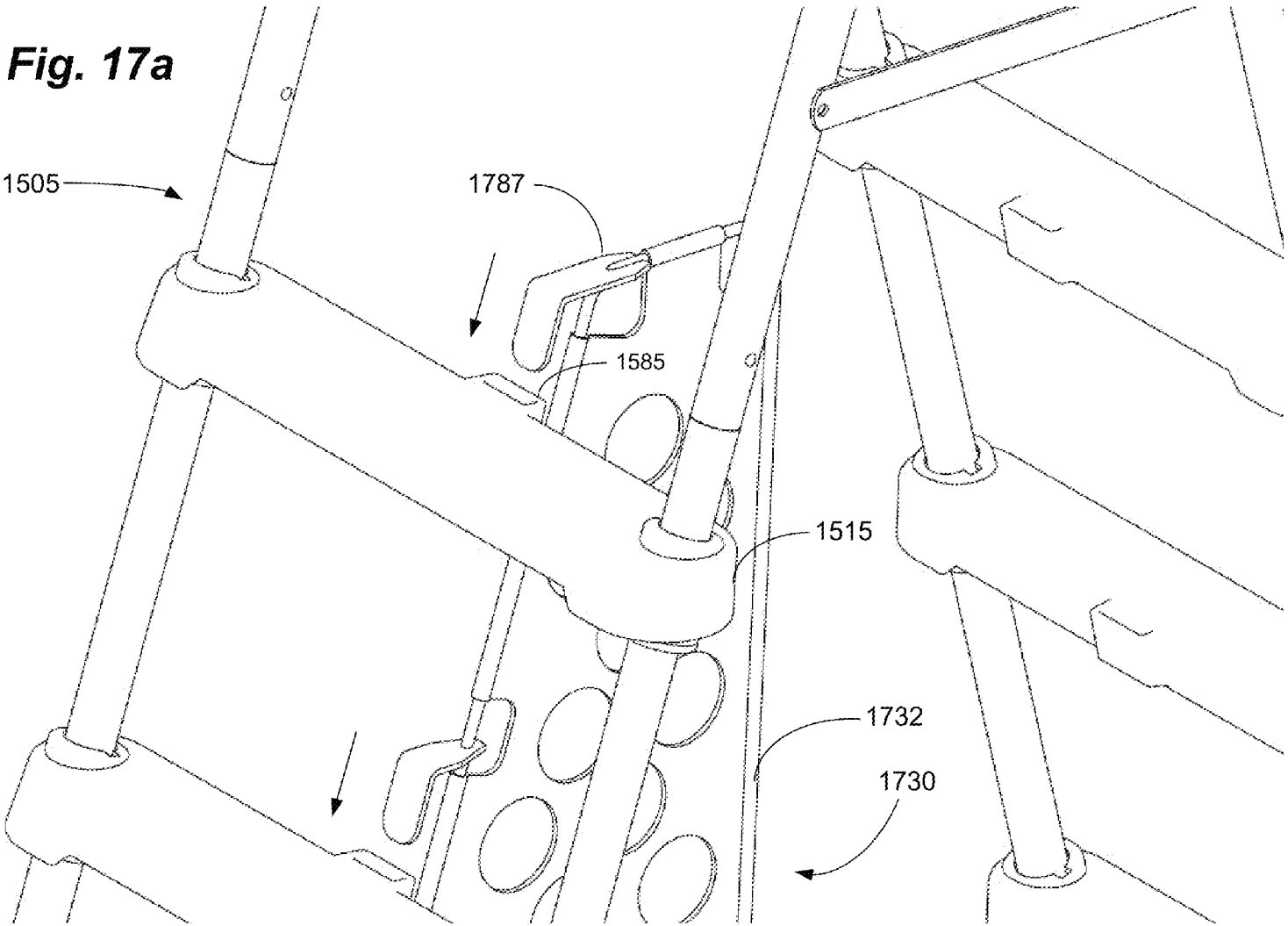
FIG. 17*a* depicts a perspective view of a frame-type embodiment of a pool ladder safety system with mounting tabs welded thereon, in accordance with some embodiments of the present invention.

As shown in FIG. 17*a*, the side guard 1730 can further comprise a tab 1787. The tab 1787 can be permanently or temporarily attached to the side guard 1730 using, for example and not limitation, screws, bolts, rivets, or adhesive. In some embodiments, the tab 1787 can be permanently welded to the side guard 1730. In other embodiments, the tab 1787 can be integrally cast with the frame 1732.

Figure 17B:
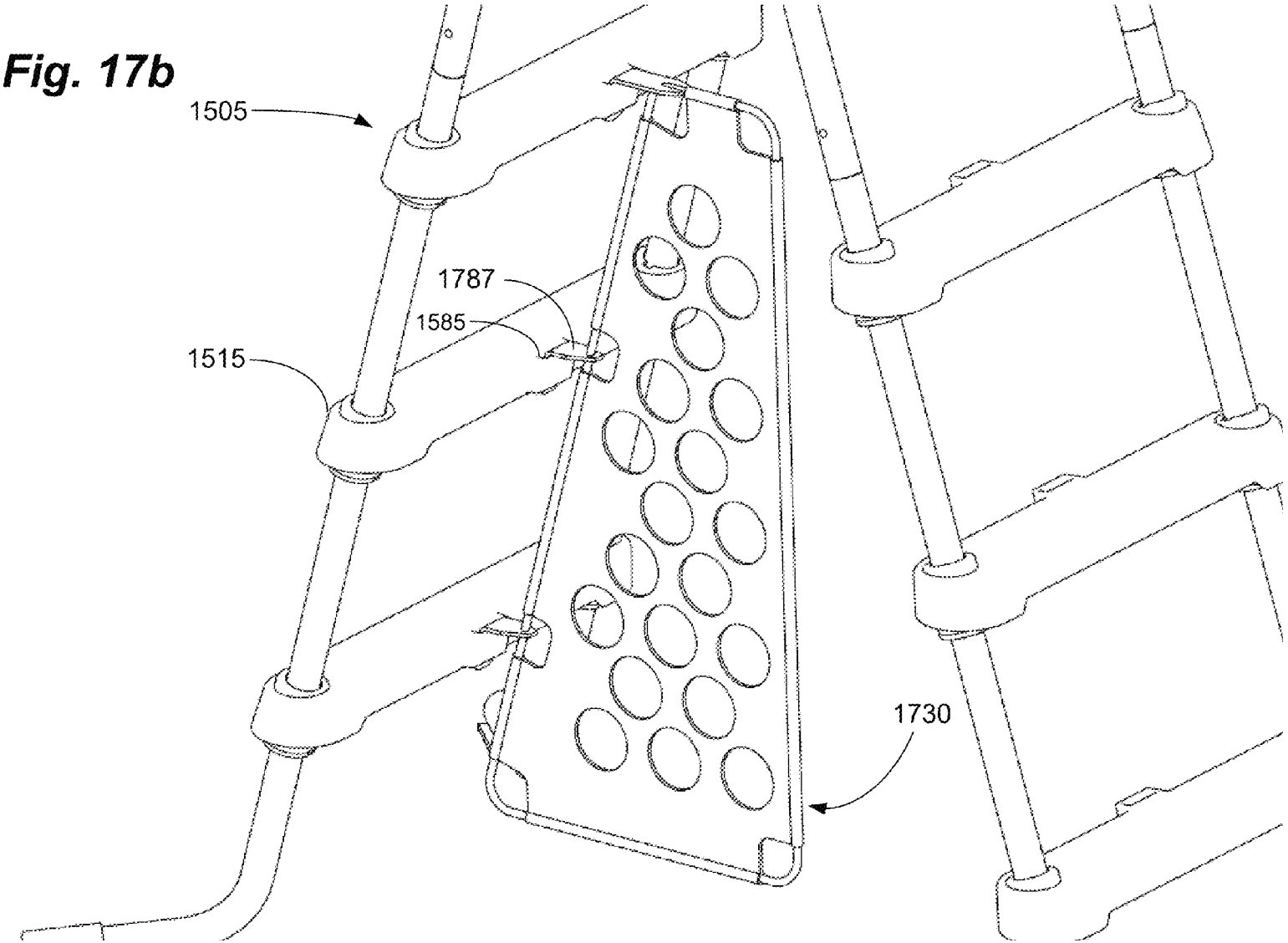
FIG. 17*b* depicts a detailed, perspective view of the frame-type embodiment of a pool ladder safety system of FIG. 17*a* engaged with the attachment slot of the ladder of FIGS. 15 and 16, in accordance with some embodiments of the present invention.
Figure 18:
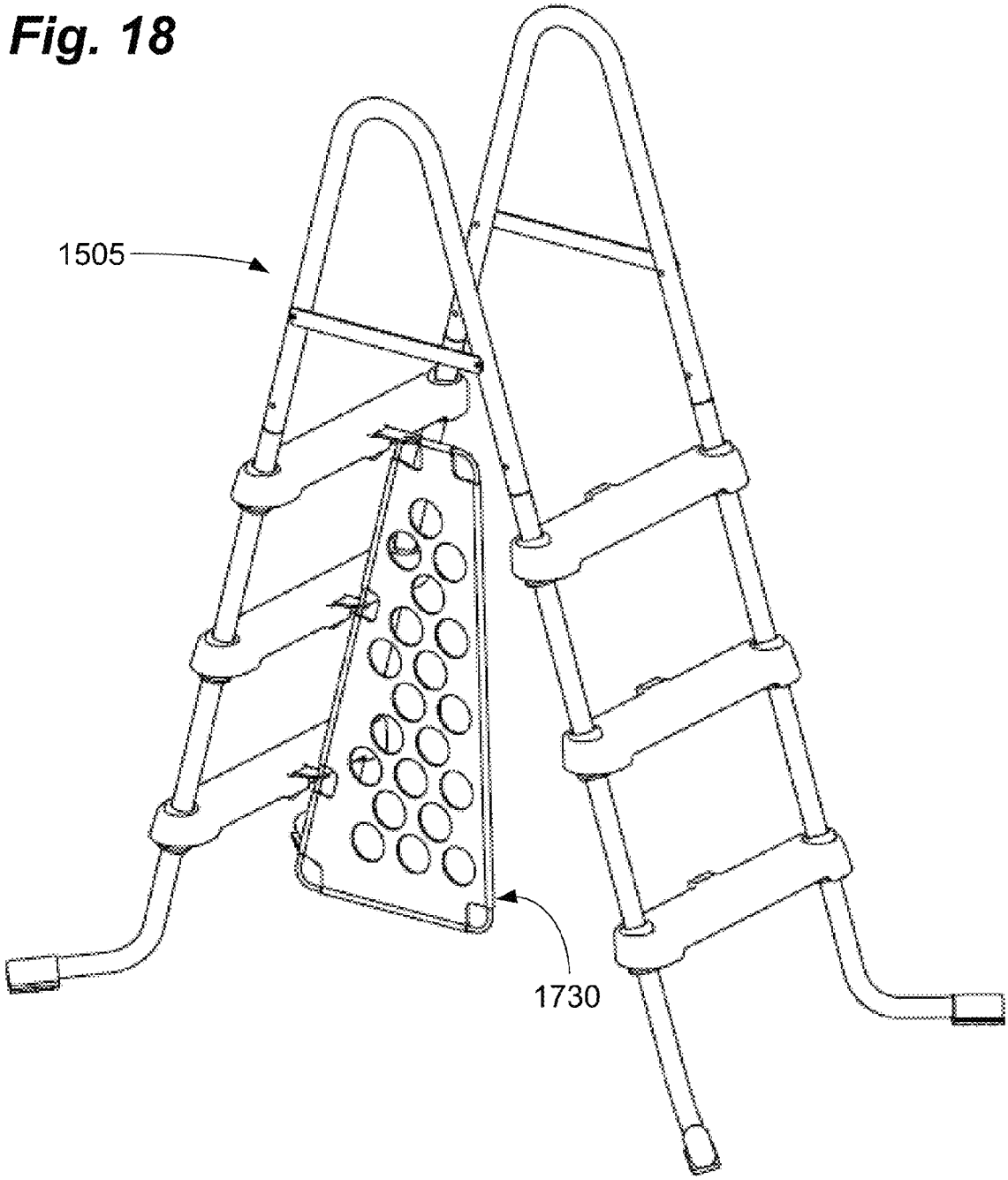
FIG. 18 depicts a perspective view of the frame-type embodiment of a pool ladder safety system of FIGS. 17*a* and 17*b* engaged with the attachment slot of the ladder of FIGS. 15 and 16, in accordance with some embodiments of the present invention.

As shown in FIG. 17*b*, the tab 1787 can be slideably engageable with the slot 1585 on the rung 1515. This can enable the side guard 1730 to be installed on the ladder 1505 by sliding the tabs 1787 on the side guard 1530 into the slots 1585 on the ladder 1505. In this manner, the weight of the side guard 1730 can hold it in place on the ladder 1505. In addition, the side guard 1530 can be easily removed, for example, to enable cleaning or maintenance of the pool or the ladder 1505. FIG. 18 depicts the side guard 1530 installed on the inner ladder 1505.

Figure 19A:
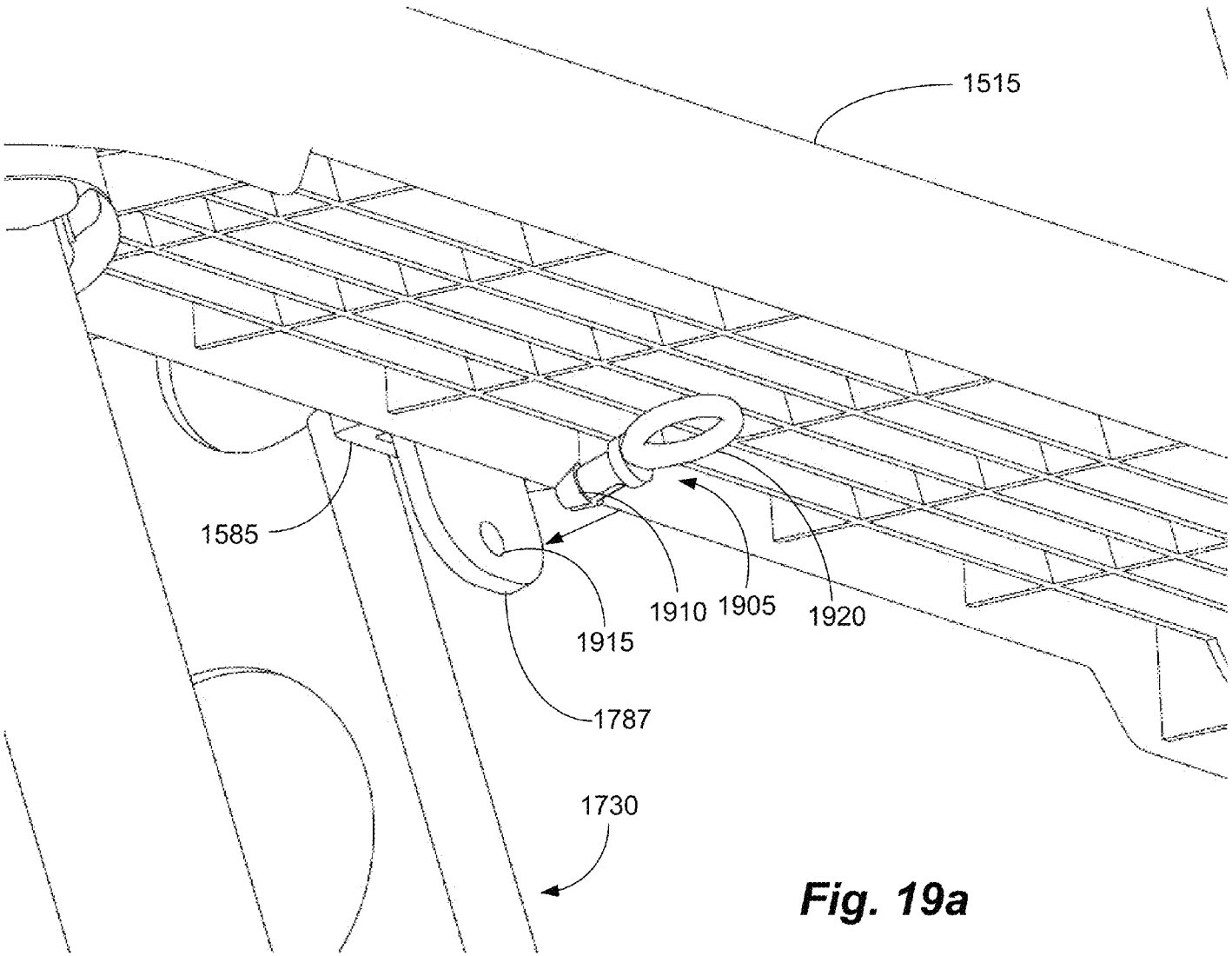
FIG. 19*a* depicts a perspective view of a retaining pin for use with various embodiments of the present invention.

As shown in FIG. 19, a retaining pin 1905 can secure the tab 1787 within the slot 1585 in the rung 1515. This can prevent the tabs 1787 on the side guard 1730 from inadvertently disengaging from the slot 1585. The added security of the retaining pin 1905 can be useful when there are strong currents in the pool. The currents can be the result of, for example and not limitation, excessive activity in the pool (i.e., lots of children plating) or when the pump is activated to clean the pool.

Figure 19B:
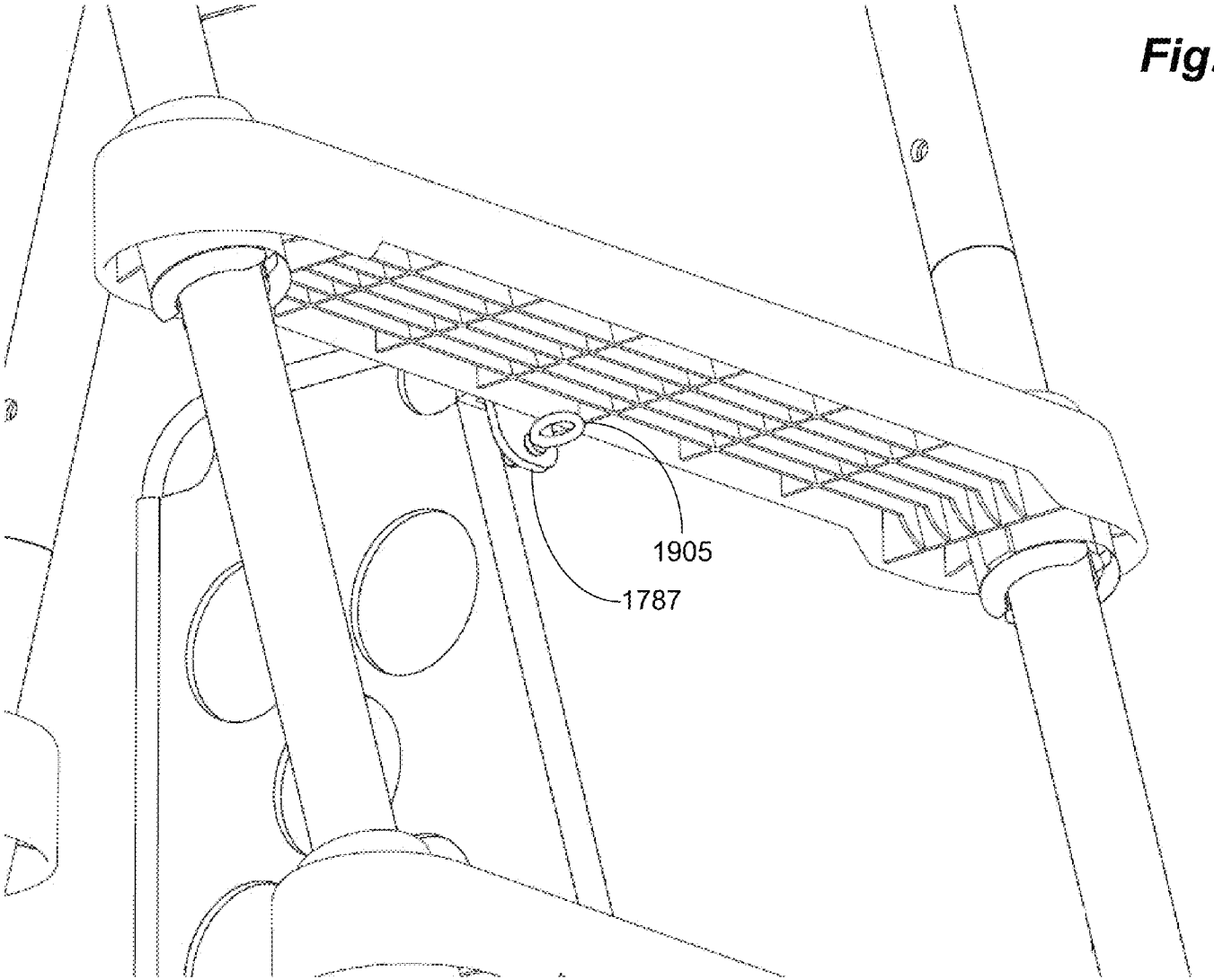
FIG. 19*b* depicts a perspective view of the retaining pin of FIG. 19*a* in an inserted position, in accordance with some embodiments of the present invention.

In some embodiments, the retaining pin 1905 can further comprise one or more securing tabs 1910. The securing tabs 1910 can be configured to engage a hole 1915 in the tab 1787 to retain the retaining pin 1905 therein. The retaining pin 1905 can nonetheless be removed by pressing the tabs 1910 inward to clear the hole 1915. In some embodiments, the retaining pin 1905 can further comprise a handle, or ring 1920, to facilitate removal of the retaining pin 1905 when desired (e.g., for cleaning or maintenance of the pool). Of course other securing means 1910 could be used and are contemplated herein. FIG. 19*b* depicts the retaining pin 1905 inserted in the tab 1787 to retain the tab 1787 in the slot 1585.

While embodiments of the invention have been disclosed in preferred forms, it will be apparent to those skilled in the art that many modifications, additions, and deletions can be made therein without departing from the spirit and scope of the invention and its equivalents, as set forth in the following claims. For example, while disclosed for use with an above-ground pool, the ladder safety system can readily be adapted for use with in-ground pools. The materials and configurations disclosed herein are intended to serve illustrative and explanatory purposes only and should not be construed, in any way, as a limitation to the present invention.

What is claimed is:

1. A ladder safety system comprising:

a first side guard shaped to substantially occupy an area between a pool ladder and an interior sidewall of an above-ground pool to prevent objects from entering an area between the ladder and the interior sidewall, the first side guard defining at least one aperture to enable media within the pool to pass therethrough, the first side guard comprising:

a frame shaped to substantially conform to a shape of the area between the ladder and the interior sidewall of the above-ground pool; and a cover, attached to the frame, to substantially fill an interior portion of the frame, the cover defining the at least one aperture;

wherein the frame is substantially trapezoidal and comprises a top, a bottom, a first side, and a second side; and wherein the first side is disposed near the interior sidewall of the pool and is substantially vertical; and wherein the second side is disposed such that it is substantially parallel to stiles of the ladder; and an attachment assembly for detachably coupling the first side guard to the assembled ladder, the attachment assembly comprising:

a mounting slot integrally cast in a rear portion of a ladder rung on the ladder; and an attachment tab, welded to the first side guard;

wherein the attachment tab is slideably engageable within the mounting slot for detachably coupling the first side guard to the ladder.

2. The ladder safety system of claim 1, wherein the first side guard and the attachment assembly are molded from a single piece of material.

3. The ladder safety system of claim 1, wherein the cover comprises an ultraviolet stabilized material.

4. The ladder safety system of claim 1, wherein the cover comprises a vinyl material.

5. The ladder safety system of claim 1, further comprising a retaining pin for retaining the attachment tab in the mounting slot.

6. A safety system for above-ground pools, the safety system comprising:

a free-standing A-frame ladder system comprising:

an inner ladder disposed inside the pool;

an outer ladder disposed outside the pool; and one or more rungs disposed between a first frame of the A-frame ladder system and a second frame of the A-frame ladder system, each said one more rungs comprising a mounting slot integrally cast into each of the one or more rungs at a location between the first frame and the second frame;

a guard assembly shaped to substantially occupy an area between the inner ladder and a sidewall of the pool, the guard assembly comprising:

a frame shaped to substantially conform to a shape of the area between the inner ladder and an interior of a sidewall of the above-ground pool; and a cover, attached to the frame, to substantially fill an interior portion of the frame, the cover defining at least one vent hole to enable water within the pool to pass through the guard assembly; and wherein the frame is substantially trapezoidal and comprises a top, a bottom, a first side, and a second side; and wherein the first side is disposed near the interior of the sidewall of the pool and is substantially vertical; and wherein the second side is disposed such that it is substantially parallel to stiles of the ladder; and one or more attachment tabs, attached to the guard assembly, and configured to slideably engage the mounting slots in the one or more rungs for securing the guard assembly to the inner ladder.

7. The ladder safety system of claim 6, wherein the guard assembly and the one or more attachment tabs are blow molded from a single piece of plastic.

8. The ladder safety system of claim 6, wherein the one or more attachment tabs are welded to the guard assembly.

9. The ladder safety system of claim 6, wherein the one or more attachment tabs are riveted to the guard assembly.

10. The ladder safety system of claim 6, wherein the one or more ladder rungs and the mounting slots are integrally cast from a thermoplastic.

11. The ladder safety system of claim 6, further comprising one or more retaining pins having one or more retaining tabs for removably securing the one or more attachment tabs in the mounting slots.

12. In an above-ground pool with an A-frame ladder system comprising an inner ladder, disposed inside the above-ground pool, an outer ladder, disposed outside the above-ground pool, and one or more rungs comprising one or more integral mounting slots, a ladder safety system comprising:

a first side guard to prevent objects from entering an area between the A-frame ladder system and an interior sidewall, the first side guard comprising:

a frame detachably attachable to the A-frame ladder system, the frame shaped to substantially conform to an area between the A-frame ladder system and an interior sidewall of the above-ground pool;

a cover, disposed over the frame, and defining one or more openings to enable water within the pool to pass therethrough; and one or more mounting tabs welded to the frame for slideably engaging the one or more integral mounting slots on the A-frame ladder system, the one or more mounting tabs comprising one or more retaining holes;

wherein the frame is substantially trapezoidal and comprises a top, a bottom, a first side, and a second side; and wherein the first side is disposed near the interior sidewall of the pool and is substantially vertical; and wherein the second side is disposed such that it is substantially parallel to stiles of the ladder; and one or more retaining pins for engaging the one or more retaining holes in the one or more mounting tabs to retain the first side guard in the one or more integral mounting slots on the A-frame ladder system.

13. The ladder safety system of claim 12, wherein the frame comprises a rust resistant material.

14. The ladder safety system of claim 12, wherein the cover comprises vinyl welded to the frame.

15. The ladder safety system of claim 12, wherein the frame comprises powder coated steel.

16. The ladder safety system of claim 12, wherein the one or more retaining pins further comprise:

one or more retaining tabs for frictionally engaging the one or more retaining holes in the one or more mounting tabs; and a ring, to facilitate removal of the one or more retaining pins.

* * * * *